US007334298B2

(12) United States Patent
Willat et al.

(10) Patent No.: US 7,334,298 B2
(45) Date of Patent: Feb. 26, 2008

(54) WRITING IMPLEMENT HAVING DEFORMABLE GRIP

(75) Inventors: Boyd Willat, Los Angeles, CA (US); Ted Caligiuri, Encinitas, CA (US); Dan Kostrikin, Los Angeles, CA (US)

(73) Assignee: Sanford, L.P., Oak Brook, IL (US)

( * ) Notice: Subject to any disclaimer, the term of this patent is extended or adjusted under 35 U.S.C. 154(b) by 0 days.

(21) Appl. No.: 10/798,663

(22) Filed: Mar. 11, 2004

(65) Prior Publication Data

US 2004/0217555 A1 Nov. 4, 2004

Related U.S. Application Data

(62) Division of application No. 09/483,807, filed on Jan. 15, 2000, now abandoned.

(51) Int. Cl.
*E05B 1/00* (2006.01)

(52) U.S. Cl. ..... 16/435; 16/422; 16/431; 401/6

(58) Field of Classification Search ..... 16/435, 16/422, 431, DIG. 12, DIG. 19, 421, 430; 401/6 X, 7, 48, 54; 264/45.2, 295, 296, 320, 264/267, 250 X See application file for complete search history.

(56) References Cited

U.S. PATENT DOCUMENTS

| | | | | |
|---|---|---|---|---|
| 141,287 | A | 7/1873 | Ormdorff | |
| 255,961 | A | 4/1882 | Faber | |
| 412,479 | A | 10/1889 | Davis | |
| 544,990 | A | 8/1895 | Miller | |
| 614,630 | A | 11/1898 | Stewart | |
| 624,853 | A | 5/1899 | Oberbeck | |
| 770,363 | A | 9/1904 | Goldsmith | |
| 782,388 | A | 2/1905 | Goldsmith | |
| 839,537 | A | 12/1906 | Beamel | |
| 1,868,441 | A * | 7/1932 | Colfelt | 15/443 |
| 2,205,769 | A | 6/1940 | Sweetland | |
| 2,236,194 | A | 3/1941 | Lorber | |

(Continued)

FOREIGN PATENT DOCUMENTS

DE 1511325 7/1969

(Continued)

OTHER PUBLICATIONS

U.S. Appl. No. 10/676,510, Willat.

(Continued)

*Primary Examiner*—Jennifer H. Gay
*Assistant Examiner*—Mark Williams
(74) *Attorney, Agent, or Firm*—Marshall, Gerstein & Borun LLP

(57) ABSTRACT

A deformable sleeve for attachment to various products for use as a grip and/or to provide a stylish appearance. The deformable sleeve features two membranes that define a cavity filled with a formable material. The deformation of the sleeve results in greater comfort for the user where the sleeve is mounted on products that are manually manipulated or are otherwise contacted by the user. In one preferred embodiment, the sleeve can be mounted on a writing instrument for use as a grip. Alternatively, the sleeve c-an be filled with a formable material that will resume its original shape after being deformed.

10 Claims, 23 Drawing Sheets

U.S. PATENT DOCUMENTS

| | | | | | |
|---|---|---|---|---|---|
| 2,362,948 | A | | 11/1944 | Teaque et al. | |
| 2,845,047 | A | | 7/1958 | McKendree | |
| 3,269,399 | A | | 8/1966 | Smith | |
| 3,548,420 | A | * | 12/1970 | Spence | 623/37 |
| 3,663,973 | A | * | 5/1972 | Spence | 528/15 |
| 3,782,390 | A | | 1/1974 | Johnson | |
| 3,863,271 | A | | 2/1975 | Maroney | |
| 4,035,089 | A | | 7/1977 | Schwartz et al. | |
| 4,044,625 | A | | 8/1977 | D'Haem et al. | |
| 4,050,727 | A | | 9/1977 | Bonnes | |
| 4,167,347 | A | | 9/1979 | Hoyle | |
| 4,168,754 | A | | 9/1979 | Nyholm | |
| 4,338,270 | A | * | 7/1982 | Uffindell | 264/46.4 |
| 4,364,150 | A | | 12/1982 | Remington | |
| 4,385,024 | A | * | 5/1983 | Tansill | 264/223 |
| 4,601,598 | A | | 7/1986 | Schwartz | |
| 4,617,697 | A | * | 10/1986 | David | 16/421 |
| 4,719,063 | A | | 1/1988 | White | |
| 4,737,226 | A | | 4/1988 | Inoue | |
| 4,911,569 | A | * | 3/1990 | Hashimoto et al. | 401/55 |
| 4,932,800 | A | | 6/1990 | Lin et al. | |
| 4,934,024 | A | | 6/1990 | Sexton | |
| 5,000,599 | A | * | 3/1991 | McCall et al. | 401/6 |
| 5,050,289 | A | | 9/1991 | Uffindell | |
| 5,159,717 | A | | 11/1992 | Drew et al. | |
| 5,190,504 | A | | 3/1993 | Scatterday | |
| 5,216,091 | A | * | 6/1993 | Stern et al. | 525/444 |
| D338,915 | S | | 8/1993 | Willat | |
| 5,336,352 | A | | 8/1994 | Tokura | |
| 5,336,708 | A | * | 8/1994 | Chen | 524/474 |
| D362,274 | S | | 9/1995 | Willat et al. | |
| 5,716,303 | A | | 2/1998 | Scatterday | |
| 5,970,581 | A | | 10/1999 | Chadwick et al. | |
| 5,987,656 | A | | 11/1999 | Kakutani | |
| D428,553 | S | | 7/2000 | Willat et al. | |
| 6,146,038 | A | * | 11/2000 | Mittersinker et al. | 401/6 |
| 6,158,910 | A | * | 12/2000 | Jolly et al. | 401/6 |
| D439,277 | S | | 3/2001 | Rosenbaum | |
| D440,106 | S | | 4/2001 | Weisz | |
| D448,805 | S | | 10/2001 | Willat et al. | |
| D451,549 | S | | 12/2001 | Willat et al. | |
| 6,447,190 | B1 | * | 9/2002 | Kwitek | 401/6 |
| D474,809 | S | | 5/2003 | Willat et al. | |
| 6,648,535 | B2 | * | 11/2003 | Ferrara, Jr. | 401/6 |
| 6,725,505 | B2 | | 4/2004 | Willat | |
| 6,752,556 | B2 | * | 6/2004 | Pearce | 401/6 |
| 6,793,426 | B2 | * | 9/2004 | Willat | 401/6 |
| 6,835,015 | B2 | * | 12/2004 | Pearce | 401/6 |

FOREIGN PATENT DOCUMENTS

| | | |
|---|---|---|
| DE | 2157175 | 5/1973 |
| DE | 2162132 | 6/1973 |
| DE | 3406522 | 9/1985 |
| DE | 29721565 U | 3/1998 |
| DE | 10059065 | 6/2002 |
| EP | 0383685 | 8/1990 |
| GB | 1276100 | 6/1972 |

OTHER PUBLICATIONS

U.S. Appl. No. 10/798,663, Willat et al.
SkyMall Catalog, Holiday Gift Guide 1999, 2 pages.

* cited by examiner 26
10
28

30

10
32

22
10

22
10

34
10
36

176
184
10

778
186
10
22

182
194
22
10
192
190

22
188
10
180

WRITING IMPLEMENT HAVING DEFORMABLE GRIP

CROSS-REFERENCE TO RELATED APPLICATION

This application is a divisional of prior application Ser. No. 09/483,807, filed Jan. 15, 2000 now abandoned.

BACKGROUND OF THE INVENTION

This invention relates generally to improvements in deformable grips for attachment to various products, and, as in one preferred embodiment, to writing instruments with deformable grips.

Deformable grips have been known for years on various products, such as manual implements and luggage. For example, such grips are shown in U.S. Pat. Nos. 4,364,150 and 5,000,599. While the deformable grips shown in these patents are generally acceptable, these grips are intended for a specific type or types of products and are not readily removed for use as grips on other products.

One writing instrument has a conventional formable grip. The grip is located around the body of the writing instrument, adjacent to its writing end. The grip has a tubular outer membrane and a tubular metal inner sleeve mounted in a concentric relationship. The inner sleeve is rigid. Circular flanges at both ends of the grip mechanically clamp the each end of the outer membrane to a corresponding end of the metal sleeve, thereby creating an internal cavity in the space between the concentrically-mounted membrane and metal sleeve. A formable polymer is located in the cavity, between the membrane and metal sleeve. While the grip on this writing instrument is generally acceptable, the metal sleeve, membrane and flanges are relatively expensive to build and assemble. Due to the nature of the polymer materials used in the deformable grip, it is likely to need replacement after a period of time, which can in some cases be less than a year. However, the grip is not easily removed and replaced.

Accordingly, there has existed a need for an inexpensive deformable grip that can be configured for easier attachment to many types of products. The present invention satisfies this need.

DETAILED DESCRIPTION OF THE PREFERRED EMBODIMENT

Figure 1:
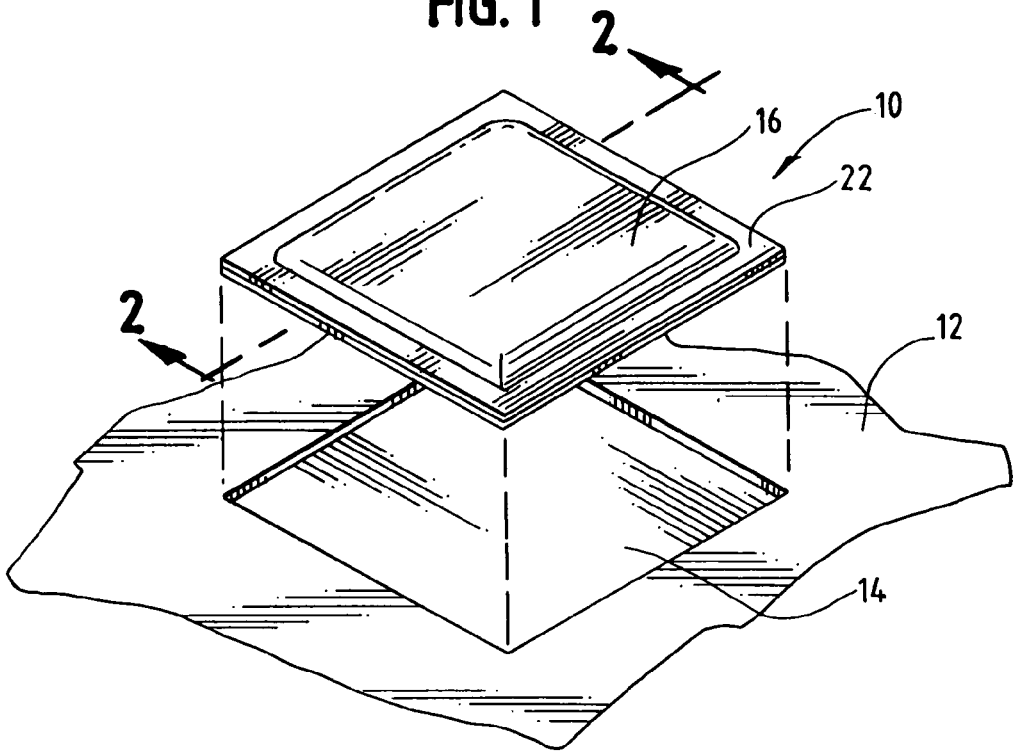
FIG. 1 is a perspective view of a first embodiment of a deformable patch according to the present invention.

Referring now to FIG. 1 of the drawings, one embodiment of the invention is a rectangular patch, or grip, indicated by the reference numeral 10, for attachment to the surface 12 of a product, in an area 14 where the product will be touched by a person or gripped or manipulated by a person's hands or fingers. For example, the area 14 where the grip 10 is attached may be on the grip area of a pair of binoculars (FIG. 16) or other optical device, such as a camera (FIG. 58), a telescope, or monocular. It should be appreciated that embodiments of the patch can be made in any shape and can provide advantages in the manufacture and/or use of all types of products. For example, the shape of the patch can be contoured or shaped to correspond to a particular area of the user's body that will contact the grip. The patch can be provided in a flat shape or a tubular shape, as described below. The patch likewise can be applied to a product to provide for a stylish appearance, even in areas where contact with a user is unlikely or infrequent. Depending on the product to which the patch is attached, the area 14 where the patch is attached may or may not be indented. It should be appreciated that flat or sleeve type patches can be used interchangeably where both will fit on a particular area of a product.

The patch 10 preferably is deformable so that it will closely conform to the fingers of different users. In other applications, the patch also will conform to other parts of a user's body that contact the patch. If the patch is reformable, it is configured to resume its original shape after deformation. In particular, the patch can be deformed and hold its deformed shape for at least 5 seconds before slowly returning to its original shape. Depending on the materials used, the patch may take much longer to return to its original shape or it may stay in its deformed shape. In one embodiment, the patch deforms and will not return to its original shape for 10-60 seconds.

By conforming to the fingers of a user, the patch more evenly distributes pressure and force across the surface of the user's fingers, thereby reducing stress and fatigue and increasing the comfort of the user. One such example is illustrated in FIG. 2A. In other applications, the patch can deform from contact with other parts of the user's body, thereby evenly distributing the force of such contact over a larger area to make such contact more comfortable to the user. The patch can be permanent or temporary and can be easily removed and replaced in applications where such removal and replacement is advantageous.

Figure 2:
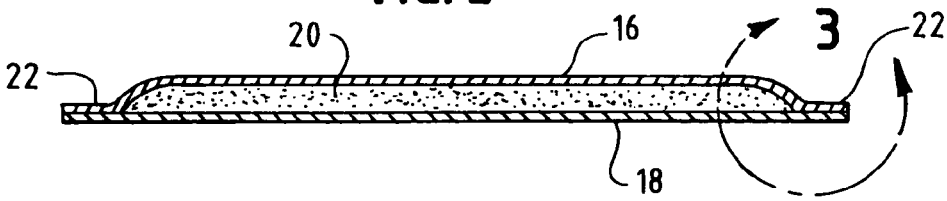
FIG. 2 is a cross-sectional view of the deformable patch of FIG. 1.
Figure 2A:
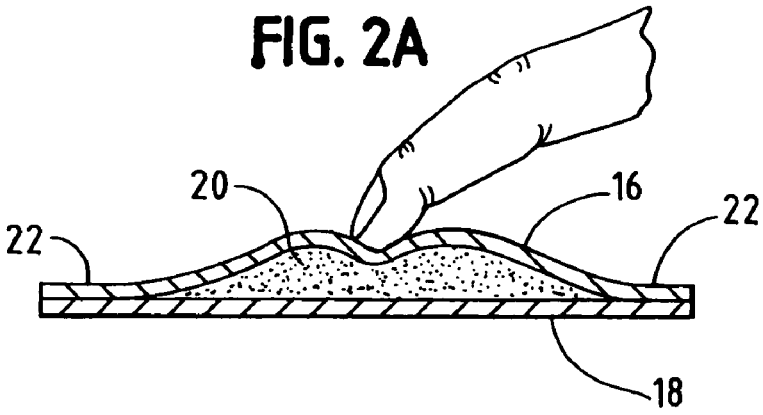
FIG. 2A is a cross-sectional view of the deformable patch of FIG. 1, showing a user's finger deforming the patch.

As shown in FIG. 2, the deformable patch 10 is closed cell having an upper membrane 16 and a base 18 that encapsulate a formable material 20. The upper membrane 16 and base 18 of the patch 10 may have rectangular or square shapes. The side edges of the upper membrane 16 are bonded to the side edges of the base 18, thereby creating a flat edge portion 22 around the patch and a cavity between the membrane and the base. The cavity is filled with the formable material 20 to facilitate the deformation of the patch 10 by the displacement of the formable material by a user's fingers or through other contact.

The formable material 20 can be viscous and can include silicone-based polymers, gels, vinyl elastomers, or any other material of sufficient properties to allow the deformation of the patch 10 from user contact. Materials can also be used to provide a slow reformation of the original patch shape after it has been deformed and released. In this regard, a silicone gel or other non-cross-linked polymer or uncatalyzed materials may be used. It should be appreciated that the composition of the formable material could be altered for applications in which varied patch characteristics are desired (i.e. more stiffness, durability, more or less deformability and/or longer-lasting deformation). The formable material may be elastically deformed or it may be deformed by displacement, which is the actual movement or flow of the material in response to pressure, such as that from a user's fingertips. In addition, the formable material could be altered for applications in which varied temperature conditions would be encountered during the use of particular products on which the patch is mounted.

The base 18 can be made of any material, rigid or elastic, including various plastic or metal materials, or it can be made of a membrane formed of thin rubber-based material, deformable plastic or silicone-based materials or other elastomeric materials suitable for a given application. If the base is configured as a flexible membrane, the patch can more easily conform to the product's surface 14, thereby increasing the ease with which the patch can be installed, removed, and replaced. Likewise, the upper membrane 16 also can be made of a thin rubber-based material, deformable plastic or silicone polymer materials, or other elastomeric materials suitable for a given application. If the base and membrane are made of silicone material, both should be from 0.50 mm to 2.5 mm in thickness. In this regard, the base may be a membrane instead of a piece of rigid material. Other thicknesses may be appropriate depending on the material used and the requirements of a particular application.

Figure 3:
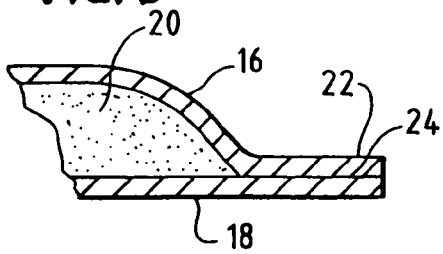
FIG. 3 is a cross-sectional view of the deformable patch depicted in FIG. 2, taken in the direction of lines 3-3.

As shown in FIG. 3, an adhesive can be placed on area 24, between the edges 22 of the upper membrane 16 and the base 18, to bond the base to the membrane. If a glue is used, the formable material 20 would be placed on the central portion of the base 18 and glue would be applied to the edges of the base. The upper membrane can then be placed over the formable material so that the edges of the upper membrane align with the edges of the base and pressure can be applied until the glue cures to bond the membrane 16 to the base 18. Such pressure can be applied by a mold, a press, or by hand. If the base and membrane edges do not align, they can be trimmed or cut after the membrane is bonded to the base.

Figure 4:
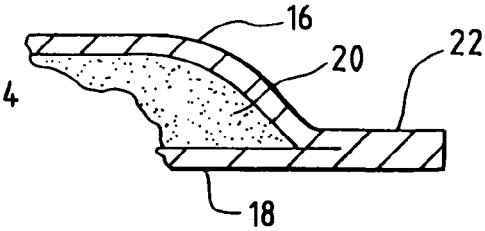
FIG. 4 is a cross-sectional view of an alternative design of the patch of FIG. 3.

Alternatively, shown in FIG. 4, raw uncatalyzed material can be applied to the area 24 between the side edges 22 of the membrane 16 and base 18. The membrane 16 and base 18 then can be joined in a press and heated to activate the catalyst to bond the membrane to the base and melt the materials together. If a press is used, the formable material 20 would be placed on the base 18 and then the upper membrane would be placed over the formable material. The press would then be operated to apply pressure and heat to form the patch 10. The membrane 16 and the base 18 may alternatively be formed of uncatalyzed material that is heated in a press until it is in a final, catalyzed state.

Figure 3A:
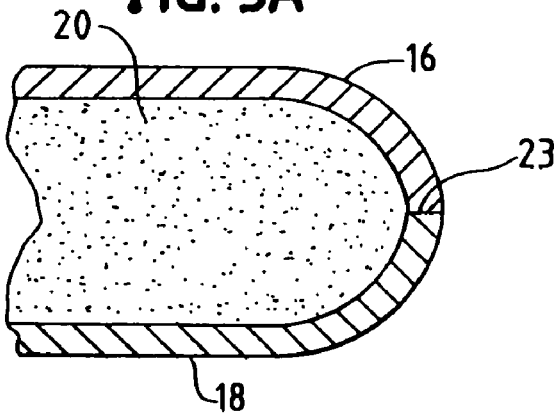
FIG. 3A is a cross-sectional view of an alternative design of the patch of FIG. 3.
Figure 4A:
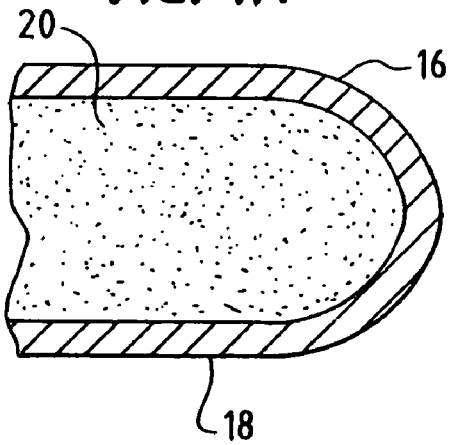
FIG. 4A is a cross-sectional view of an alternative design of the patch of FIG. 4.

As shown in FIGS. 3A and 4A, the patch 10 alternatively need not have a flat edge portion 22, depending on the requirements of a particular application. The edge areas 23 of the membrane 16 and the base 18 can be bonded, as shown in FIG. 3A. Alternatively, the membrane 16 can be melted to the base 18, as shown in FIG. 4A. The patch's edge portion 22 also could be configured as multiple tabs projecting away from the patch. Further, depending on the application, the edge portion 22 may be minimized or the upper membrane 16 may be wrapped under the base 18 so as to eliminate the edge portion 22.

While the way of joining base 18 with product patch area 14 can vary depending on the particular application, adhesives can be used on some or all of the bottom surface of the base 18 or on some or all of the edge portion of the base 18. Likewise, some or all of the edge portion 22 can be mechanically fastened or clamped to the product patch area 14. Adhesive tape or a combination of adhesive and mechanical attachment also could be used.

In applications where the patch 10 is attached to a product by an adhesive, various types of adhesives can be used depending on the type of product surface and the type of base material used. For example, if the base material 18 of the patch is silicone polymer, then cyanoacrylate glue or 3M Super Silicone brand sealant can be used. In another example, if the product surface 14 is a thermoplastic material and the base material 18 of the patch is a polyethylene plastic material, then cyanoacrylate glue or 3M Super Silicone brand sealant can be used.

One type of adhesive that may be used is 3M brand Super silicone sealant, which is a one-component, paste-like material that cures to a tough, elastomeric solid when exposed to atmospheric moisture. This sealant will adhere to clean, bare or painted metal, glass, non-oily wood, abraded rubber and many types of plastics. The sealant is a one-part vulcanizing silicone rubber type having the consistency of a non-sagging paste. It is made of 100% solids and has a net weight of approximately 8.3-8.7 pounds per gallon. This sealant is available in clear, white or black colors. The sealant can be extruded from an 0.125 inch orifice using a pressure of ninety pounds per square inch. Such extrusion results in a flow of approximately 350 gallons per minute.

The silicone sealant is of an acetoxy cure type. In particular, upon exposure to moisture, the silicone sealant will give off small amounts of acetic acid while the sealant cures. It is not recommended that the acetic acid vapors be inhaled. The sealant will cure in 24 hours and has a tack free time of 10-20 minutes at 77° F. (25° C.) with 50% relative humidity. The sealant's tensile strength is approximately 350 psi, its elongation property is 450%, and its hardness is approximately 25-30 Shore A. The sealant has temperature stability from −85° F. to 450° F. (−65° C. to 232° C.) and can withstand intermittent exposure to temperatures as high as 500° F. (280° C.). The sealant is believed to have good resistance to various weathering conditions, including UV radiation, rain, snow, etc., without hardening, cracking, or shrinking.

For optimum adhesion with the above adhesive, the product surface 14 and the lower surface of the base 18 should be clean, dry, and free from oil, grease or other foreign material. If necessary, metal surfaces should be wiped with a non-oily solvent. Rubber surfaces should be abraded to promote adhesion. Depending on environmental conditions, the base and product surface should be joined within 5-10 minutes, before the tack-free time of the sealant passes.

Figures 10, 11, 12, 13, 14:
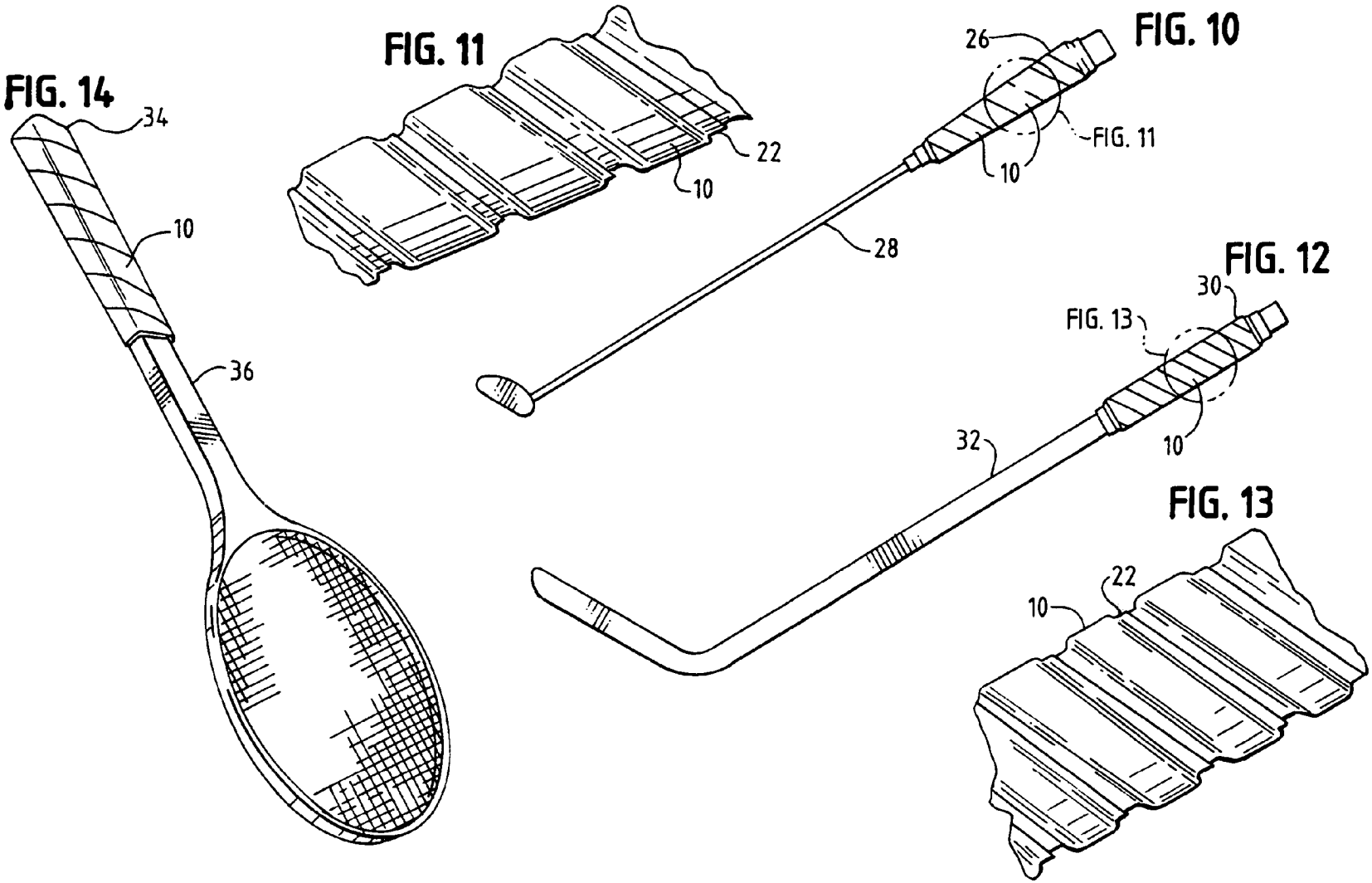
FIG. 10 is an elevational view of a golf club with a deformable patch, according to another embodiment of the present invention.
FIG. 11 is a detail view of the golf club grip, taken from area 11 of FIG. 10.
FIG. 12 is an elevational view of a hockey stick with a deformable patch, according to another embodiment of the present invention.
FIG. 13 is a detail view of the hockey stick grip, taken from area 13 of FIG. 10.
FIG. 14 is a perspective view of a tennis racquet with a deformable patch, according to another embodiment of the present invention.

The patch 10 can be used on various products that are manipulated by a user's hands or fingers. For example, FIGS. 10 and 11 show the patch 10 attached to the handle 26 of a golf club 28. In this example, the patch 10 is long and narrow, thereby allowing it to wrap around the handle of the golf club. The deformable nature of the patch allows the handle of the golf club to closely conform to the hands of the user for a more comfortable grip. The patch can be used on other sports clubs, and, in particular, on the handle 30 of a hockey stick 32 or on the handle 34 of a tennis racquet 36, as shown in FIGS. 12, 13, and 14. As shown in FIG. 13, the patch 10 is wrapped around the handle 32 of the hockey stick 32. The patch 10 on the tennis racquet 36 allows the handle 34 to closely conform to the hands of the user for a more comfortable grip. The patch 10 is attached to the handle 34 of the tennis racquet 36 in a manner similar to that shown in FIG. 13.

Figure 5:
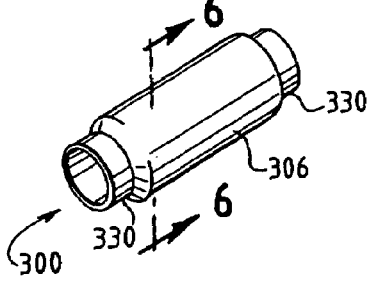
FIG. 5 is a perspective view of another embodiment of a deformable sleeve according to the present invention.

Before proceeding with additional descriptions of the products that incorporate the patch 10, it should be appreciated that FIG. 5 shows another embodiment of the patch 300 having a sleeve-type configuration (described below) that can in most cases be used instead of the patch 10. Accordingly, were a patch is referred to by reference number 10 and a patch 300 will fit on a particular product, the reference number is intended to refer to both types of patches, and visa versa.

Figure 15:
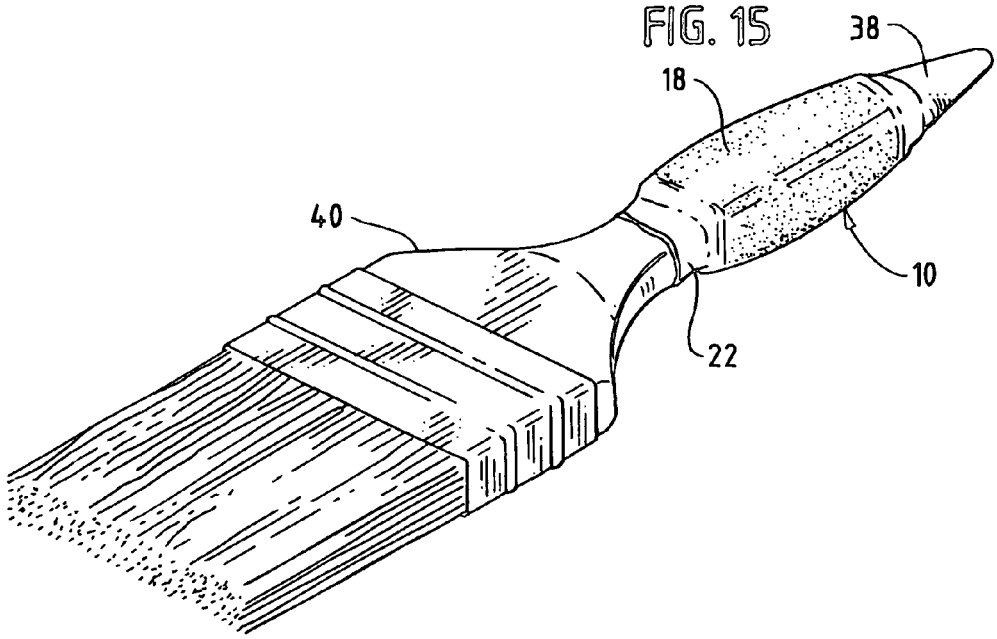
FIG. 15 is a perspective view of a paint brush with deformable patches, according to another embodiment of the present invention.

FIG. 15 shows the patch 10 attached to the handle 38 of a paint brush type painting device 40. In this example, the patch 10 is sized to wrap around the handle of the paint brush. The deformable nature of the patch allows the handle of the painting device to closely conform to the hands of different users for a more comfortable grip. It should be appreciated that the patch can be configured to attach to any type of hand-held painting device, such as roller handles, paint gun handles, or the brush-type device 40 shown in FIG. 15.

Figure 16:
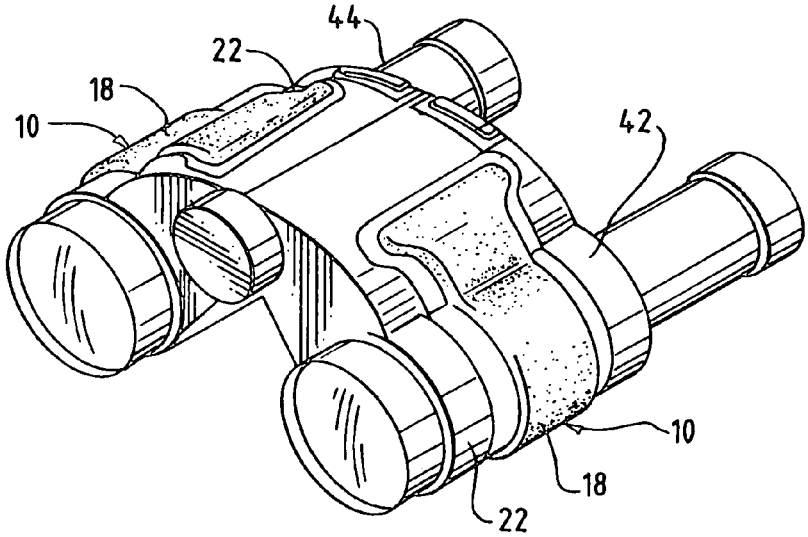
FIG. 16 is a perspective view of binoculars with deformable patches, according to another embodiment of the present invention.

FIG. 16 shows the patch 10 attached to the housing 42 of a binocular 44. In this example, the patch 10 is sized to wrap around the handle of the painting implement. The deformable nature of the patch allows the handle of the binocular to closely conform to the hands of different users for a more comfortable grip. It should be appreciated that the patch 10 can be configured to attach to any type of hand-manipulated optical device, such as a telescope, a monocular, or various types of cameras, including 35 mm film cameras, digital cameras, and video cameras.

Figure 17:
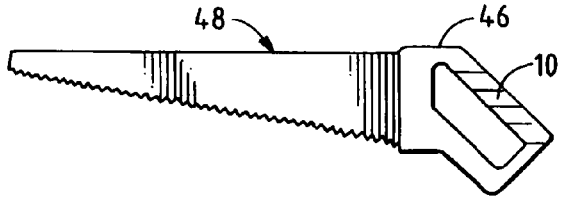
FIG. 17 is an elevational view of a saw with a deformable patch, according to another embodiment of the present invention.
Figure 18:
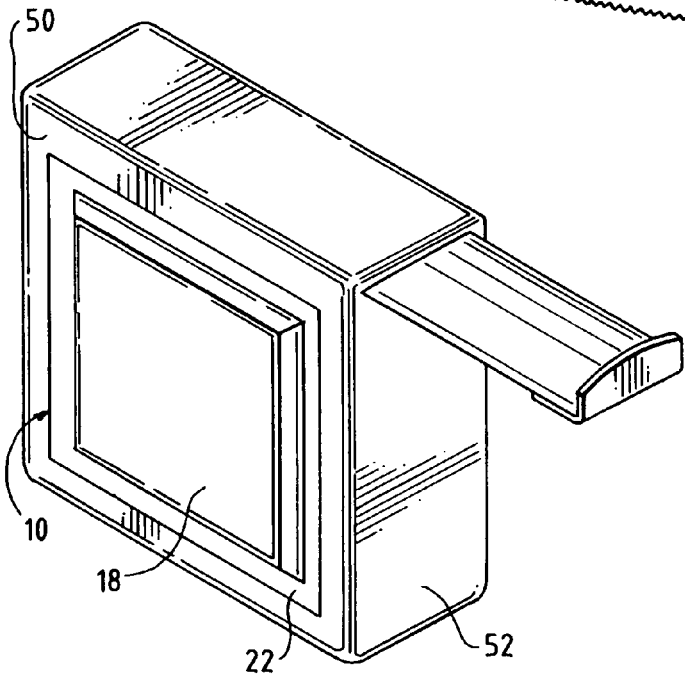
FIG. 18 is a perspective view of a tape measure with the deformable patch of FIG. 1 thereon.
Figure 19:
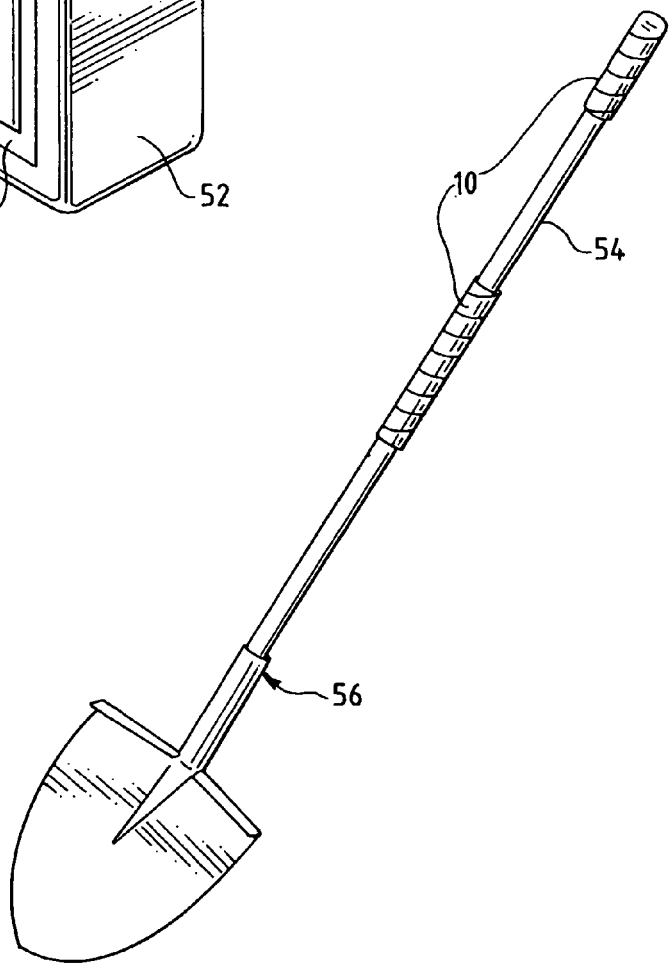
FIG. 19 is a perspective view of a shovel with deformable patches, according to another embodiment of the present invention.
Figure 20:
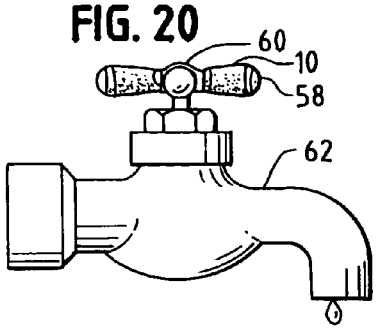
FIG. 20 is perspective view of a faucet with deformable patches, according to another embodiment of the present invention.
Figure 21:
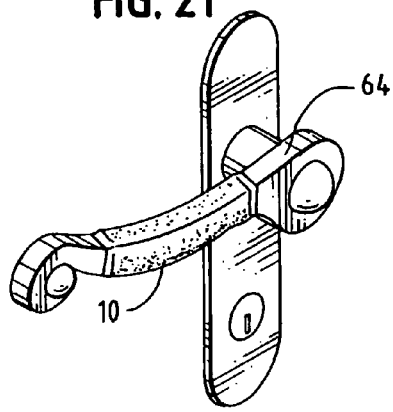
FIG. 21 is a perspective view of a door knob with a deformable patch, according to another embodiment of the present invention.
Figure 22:
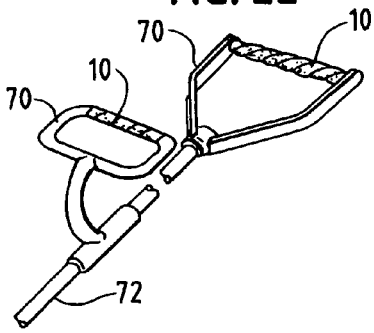
FIG. 22 is a perspective view of a weed trimmer with deformable patches, according to another embodiment of the present invention.
Figure 23:
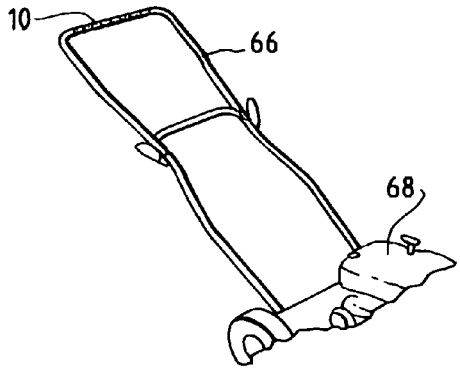
FIG. 23 is a perspective view of a lawn mower with a deformable patch, according to another embodiment of the present invention.
Figure 24:
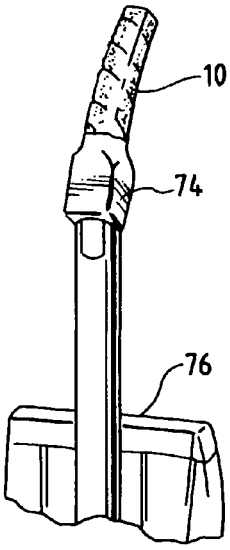
FIG. 24 is a perspective view of a vacuum cleaner with a deformable patch, according to another embodiment of the present invention.
Figure 25:
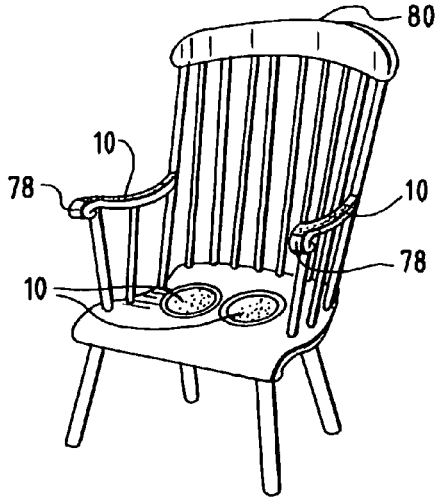
FIG. 25 is a perspective view of a chair with deformable patches, according to another embodiment of the present invention.
Figure 26:
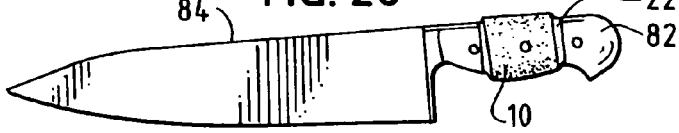
FIG. 26 is an elevational view of a knife with deformable patches, according to another embodiment of the present invention.
Figure 27:
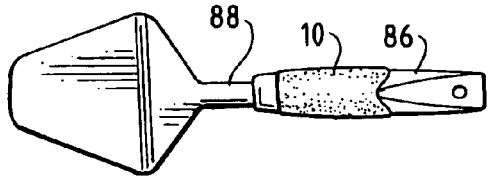
FIG. 27 is an elevational view of a spatula with deformable patches, according to another embodiment of the present invention.
Figure 28:
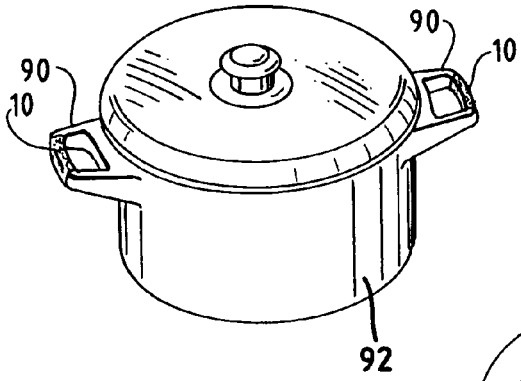
FIG. 28 is a perspective view of a cooking pot with deformable patches, according to another embodiment of the present invention.
Figure 29:
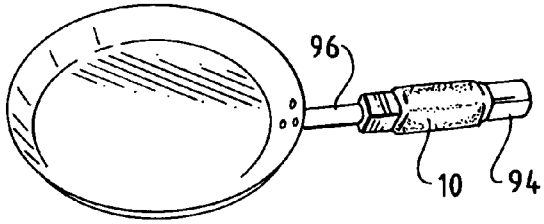
FIG. 29 is a perspective view of a pan with a deformable patch, according to another embodiment of the present invention.
Figure 30:
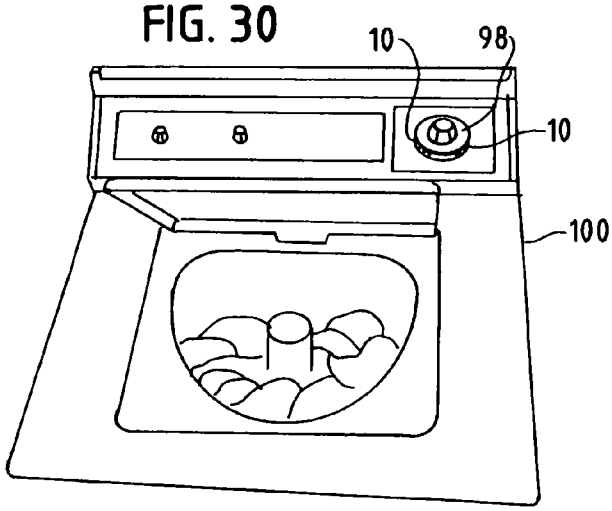
FIG. 30 is a perspective view of a laundry machine with deformable patches on its control dial, according to another embodiment of the present invention.
Figure 31:
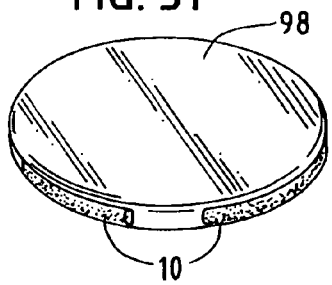
FIG. 31 is a detail perspective view of the control dial from the machine of FIG. 30.
Figure 32:
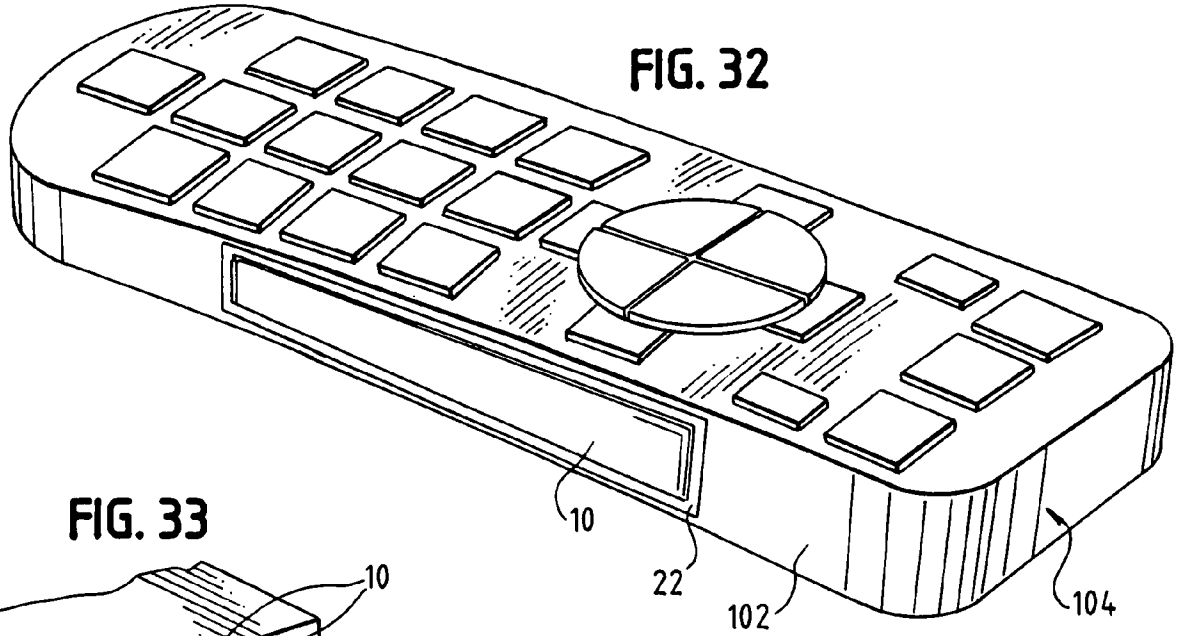
FIG. 32 is a perspective view of a remote control with deformable patches, according to another embodiment of the present invention.
Figure 33:
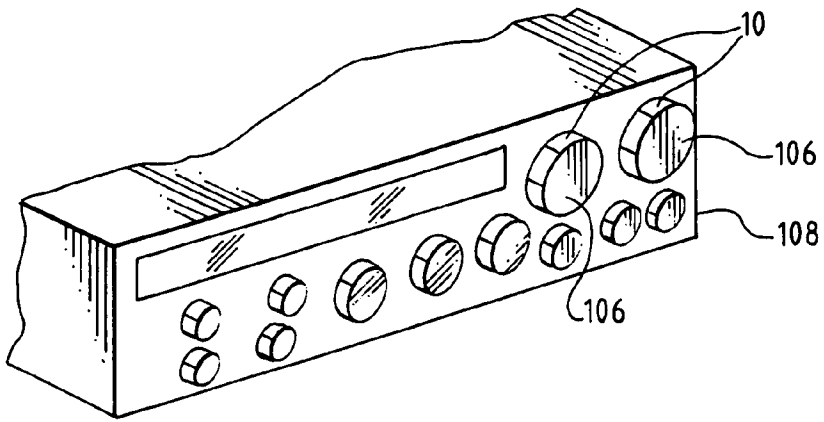
FIG. 33 is a perspective view of an audio receiver with deformable patches, according to another embodiment of the present invention.
Figure 34:
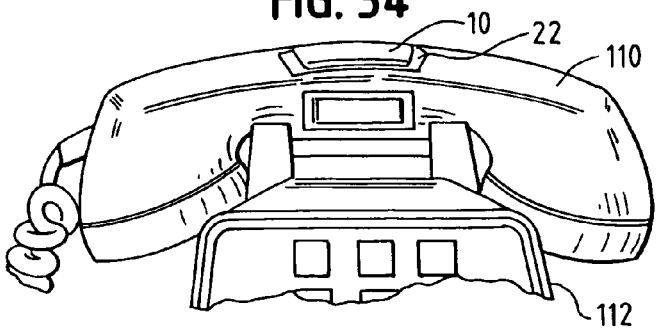
FIG. 34 is an elevational view of a telephone with deformable patches, according to another embodiment of the present invention.
Figure 35:
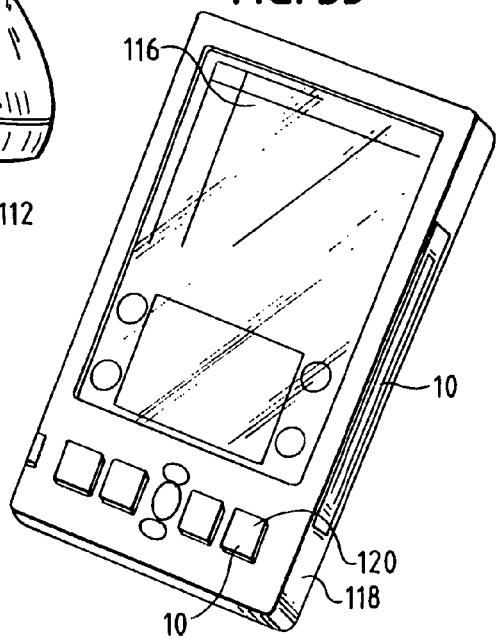
FIG. 35 is a perspective view of a personal digital assistant with deformable patches, according to another embodiment of the present invention.
Figure 36:
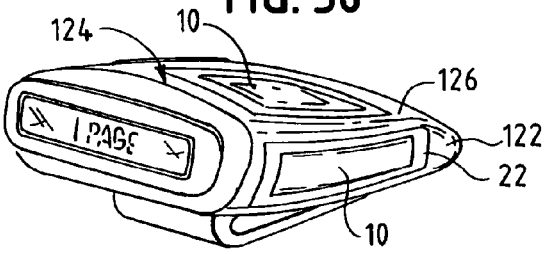
FIG. 36 is a perspective view of a pager with a deformable patch, according to another embodiment of the present invention.
Figure 37:
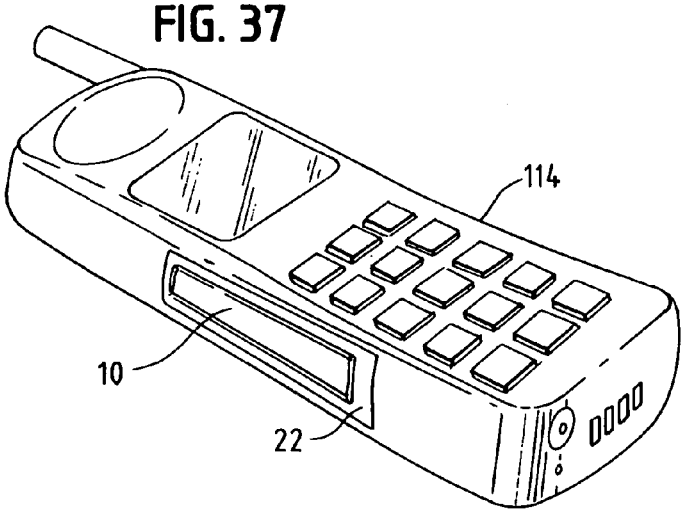
FIG. 37 is a perspective view of a telephone handset with deformable patches, according to another embodiment of the present invention.

As shown in FIGS. 17-19, the patch 10 can be configured to attach to various tools that are manipulated by hand. For example, the patch 10 can be sized to wrap around the handle 46 of a saw 48. The deformable nature of the patch allows the handle of the saw to closely conform to the hands of different users for a more comfortable grip. The patch 10 can be sized to attach to one or both of the side walls 50 of a tape measure housing 52. The housing encloses a mechanical tape measure mechanism, but also can enclose an electronic or optical measurement system. The deformable nature of the patch allows the tape measure to closely conform to the hands of different users for a more comfortable grip. The patch 10 can be sized to wrap around the handle 54 connected to a shovel head 56. The deformable nature of the patch allows the handle of the shovel to closely conform to the hands of different users for a more comfortable grip. The patch 10 can be attached in one or more locations on the shovel handle 54. Alternatively, a rake head, a hoe head or a broom head with a brush can be substituted for the shovel head 56. The patch 10 can be attached to the handles of the saw 48 and the shovel 56 in a manner similar to that shown in FIG. 13. It should be appreciated that the patch 10 can be configured to attach to any type of hand-manipulated tools, such as rakes, hoes, hedge trimmers, power saws, drills, hammers, or other types of tools.

Additional products that incorporate the patch 10 are shown in FIGS. 20-25. In particular, the patch 10 can be sized to wrap around the spokes 58 of a handle 60 on a faucet 62. The deformable nature of the patch allows the handle of the faucet to closely conform to the fingers of different users for a more comfortable grip. The patch 10 also can be sized to wrap around a door knob 64. The deformable nature of the patch allows the door knob to closely conform to the hands of different users for a more comfortable grip. The patch 10 also can be sized to wrap around the handle 66 of a lawn mower 68 or the handle 70 of a weed trimmer 72. The patch 10 can be attached to the handles of the lawn mower 68 or the weed trimmer 72 in a manner similar to that shown in FIG. 13. The deformable nature of the patch allows the handles of the lawn mower 68 and the weed trimmer 72 to closely conform to the hands of different users for a more comfortable grip. The patch 10 can be attached in one or more locations on the weed trimmer handle 70.

The patch 10 can also be attached to the handle 74 of a vacuum cleaner 76. For this application, the patch is wrapped around the vacuum cleaner handle 74 in a manner similar to that shown in FIG. 13. The patch can be mounted on the handles of other floor cleaning devices, including steam cleaners, floor polishers and carpet shampoo machines. The patch also can be attached to the armrests 78 of a chair 80 to provide a comfortable area for a user to rest his or her arms.

Additional products that can incorporate the patch 10 are shown in FIGS. 26-31. In particular, the patch 10 can be sized attach to the handle 82 on a kitchen knife 84 or to the handle 86 of a spatula 88. The patch 10 also can be sized to wrap around one or more handles 90 of a pot 92 or the handle 94 of a pan 96. It should be appreciated that the patch can be applied to other types of cookware and bakeware. For high-temperature applications where the patch components are made of silicone materials, aluminum oxide may be added to the membrane 16, base 18, and/or the formable material 20 so that the patch will survive such elevated temperatures. The aluminum oxide additive may be a 99.99% aluminum oxide sold by the Alfa Aesar company under stock number 39815. Alternatively, other additives may be used to provide durability at higher temperatures, as may be required by a particular application. The patch also can be attached to the dial 98 on a laundry cleaning machine 100, such as a washer or dryer. The deformable nature of the patch allows the handles and dial described above to closely conform to the hands of different users for a more comfortable grip.

FIGS. 32-37 show electronic products that can incorporate the patch 10. In particular, the patch can be attached to the side 102 of a remote control 104. The patch also can be attached to buttons or knobs 106 on an audio player 108, such as an FM receive or the like. The patch can be attached in one or more locations on the handset 110 of telephone 112, on a mobile phone 114, or on a personal digital assistant 116, including the sides and rear surfaces. As shown on the personal digital assistant 116 of FIG. 35, the patch 10 can be attached on the sides 118 of the digital assistant and/or over its buttons 120. The patch also can be attached to the sides 122 of a pager 124. The patch could also be attached to the back 126 of the pager.

Figure 38:
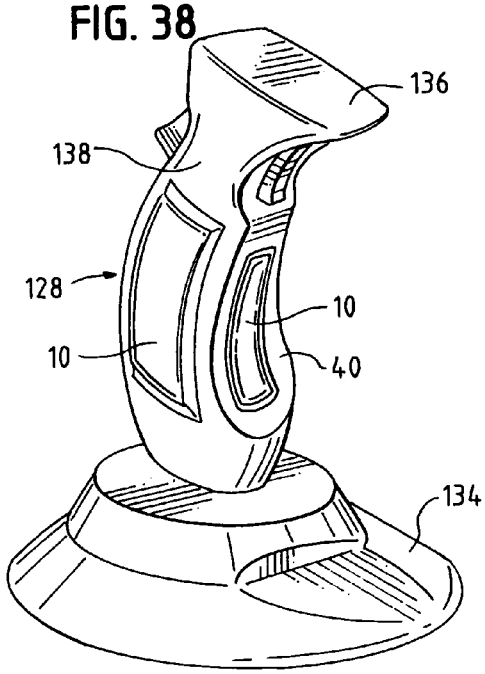
FIG. 38 is a perspective view of a joystick with a deformable patch, according to another embodiment of the present invention.
Figure 39:
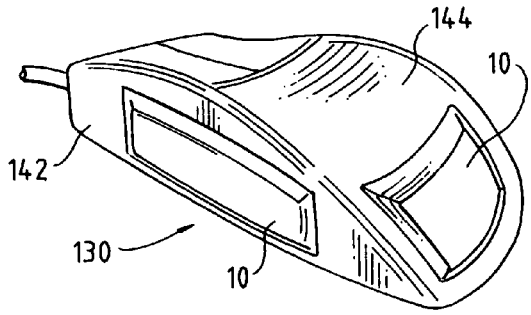
FIG. 39 is a perspective view of a computer mouse with a deformable patch, according to another embodiment of the present invention.
Figure 40:
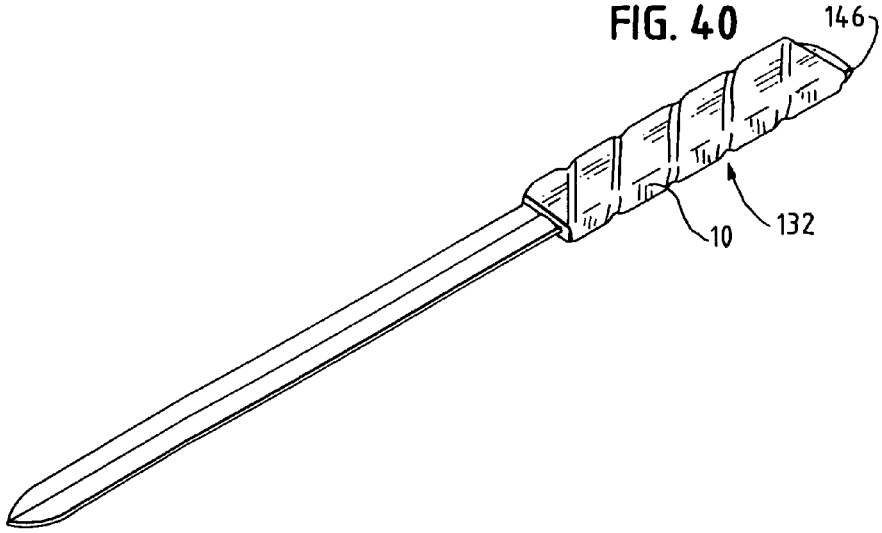
FIG. 40 is a perspective view of a letter opener with a deformable patch, according to another embodiment of the present invention.

FIGS. 38-40 show additional products incorporating various-sized patches 10, including a joystick 128, a computer mouse 130 and a letter opener 132. The joystick has a base 134 and a pivotably mounted control stick 136. Patches can be mounted on one or more surfaces on the control stick, including the side surfaces 138 and/or the rear surface 140. Likewise, a patch can be mounted to the side and/or upper surfaces 142 and 144 of the computer mouse. The patch is mounted to the handle 146 of the letter opener in a manner similar to that shown in FIG. 13.

Figure 40A:
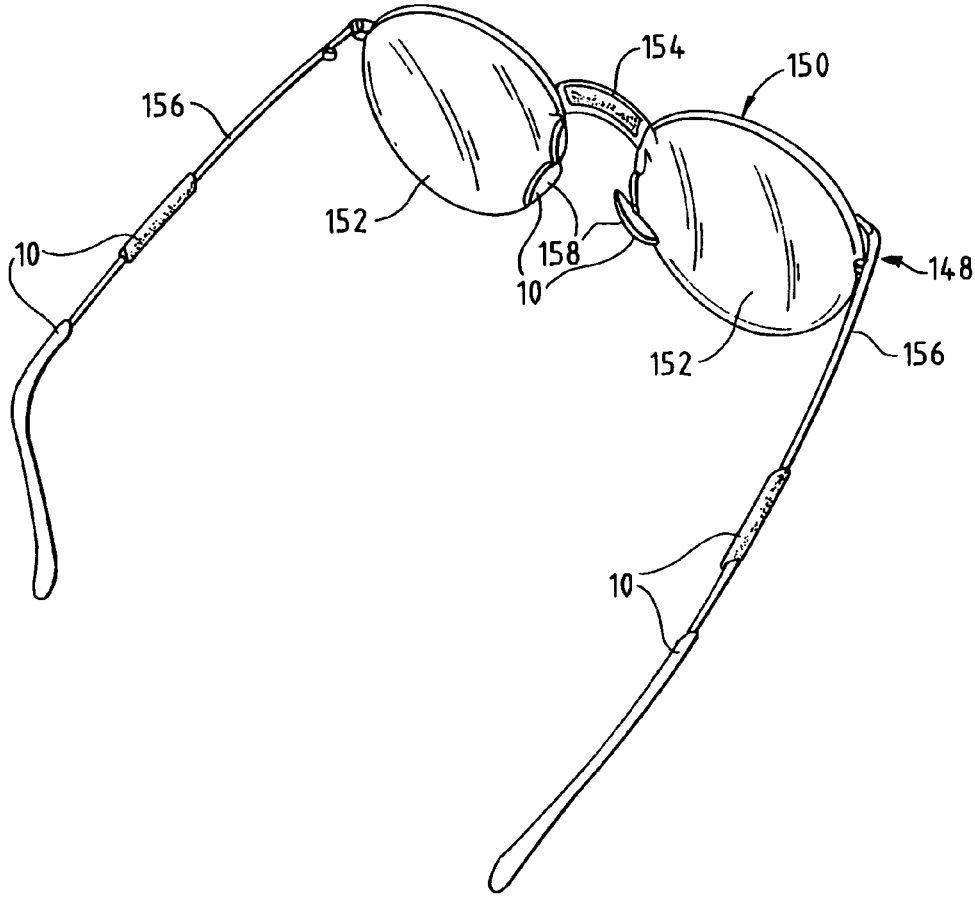
FIG. 40A is a perspective view of eyeglasses with deformable patches, according to another embodiment of the present invention.

As shown in FIG. 40A, the patch 10 can be attached to eyeglasses 148 to increase the comfort of the user. The eyeglasses have a main body 150 with lenses 152 and a bridge 154. Arms 156 extend back from the body to rest on the user's ears. Nose pads 158 extend downwardly from the body to rest on a user's nose. The patch can be sized for placement on the nose pads and/or the arms, near the area where the user's ears would contact the arms.

Figure 41:
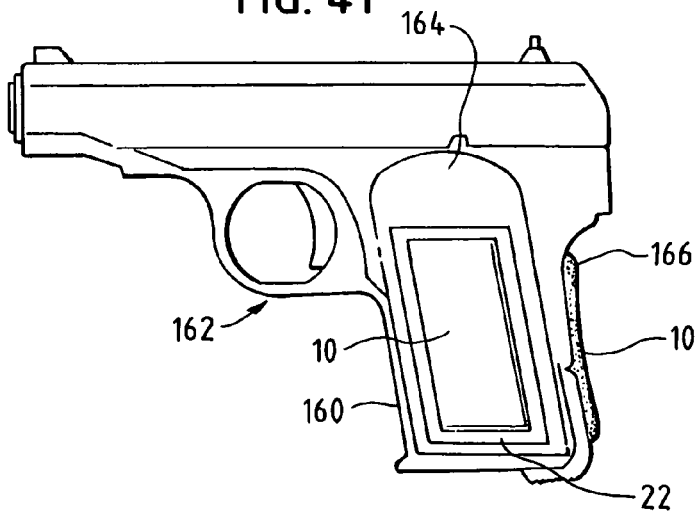
FIG. 41 is a perspective view of a firearm with deformable patches, according to another embodiment of the present invention.

As shown in FIG. 41, one or more patches 10 can be attached to the handle 160 of a firearm 162. Patches can be mounted on one ore more surfaces of the firearm handle, including on the side surfaces 164 and/or the rear surface 166. The patch on the rear surface of the firearm handle can cushion the user against recoil from firing the weapon.

Figure 42:
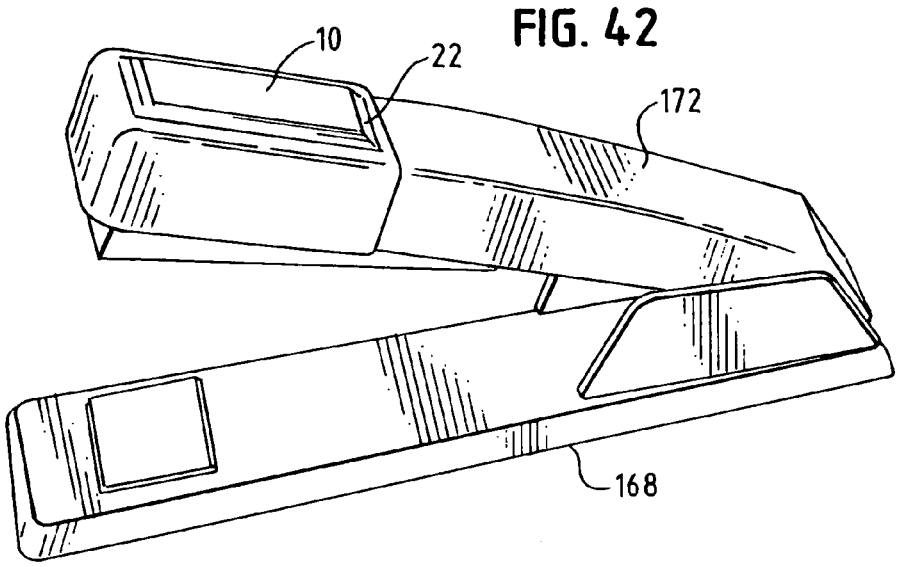
FIG. 42 is a perspective view of a stapler with a deformable patch, according to another embodiment of the present invention.
Figure 43:
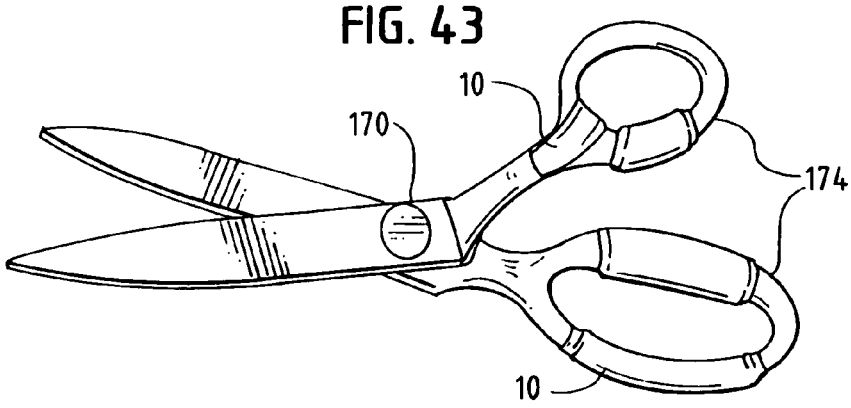
FIG. 43 is a perspective view of scissors with deformable patches, according to another embodiment of the present invention.
Figures 44, 45, 46, 47:
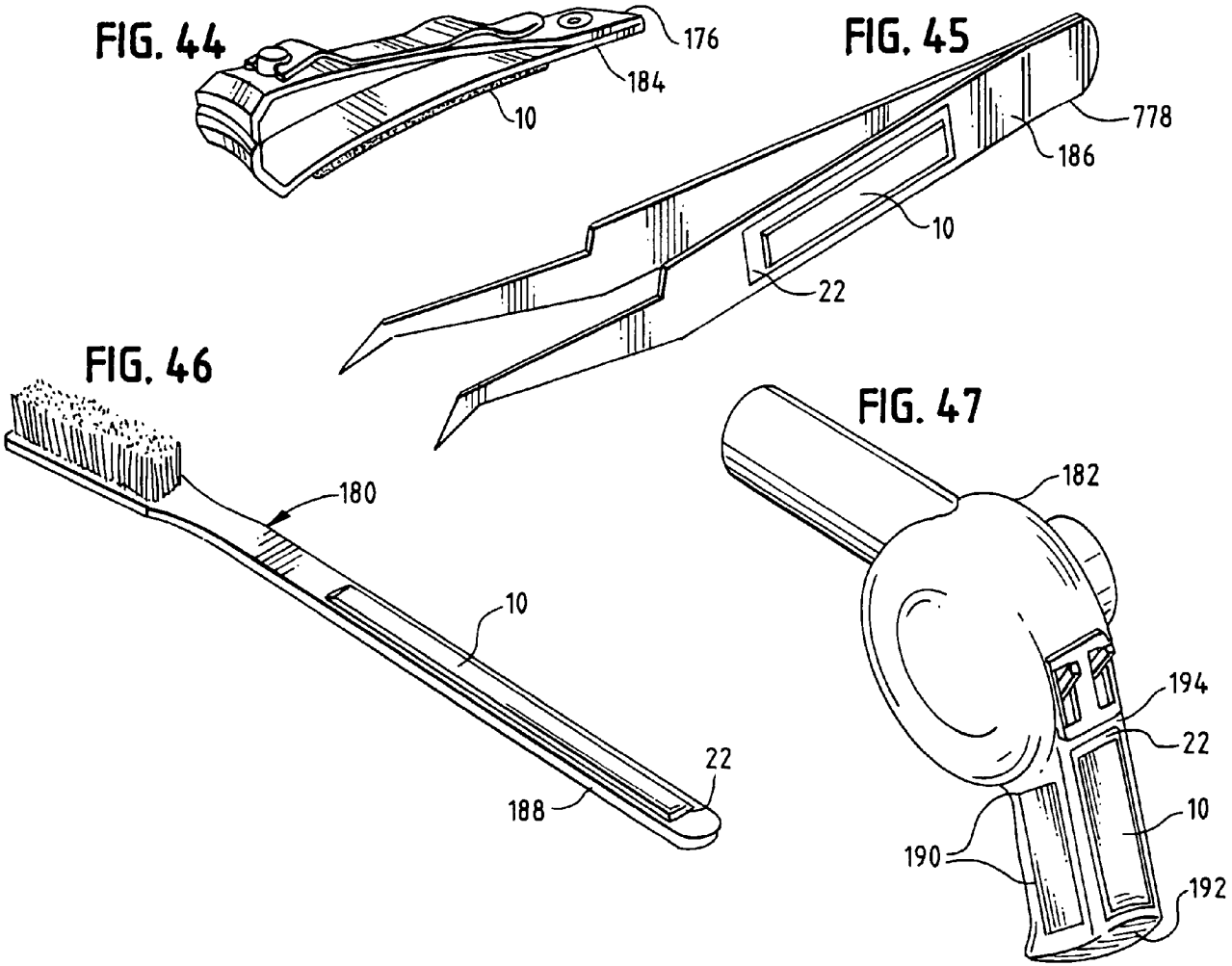
FIG. 44 is a perspective view of a clipper with a deformable patch, according to another embodiment of the present invention.
FIG. 45 is a perspective view of tweezers with deformable patches, according to another embodiment of the present invention.
FIG. 46 is a perspective view of a toothbrush with a deform able patch, according to another embodiment of the present invention.
FIG. 47 is a perspective view of a blow dryer with a deformable patch, according to another embodiment of the present invention.

As shown in FIGS. 42 and 43, patches 10 of suitable sizes can be attached to office products, including on a stapler 168 and a scissors 170. A rectangular patch is mounted to the upper surface 172 of the stapler. One or more patches also can be mounted to the handles 174 of the scissors. Other products that incorporate patches 10 are shown in FIGS. 44-47, including clippers 176, tweezers 178, a toothbrush 180, and an electric hair dryer 182. With regard to the clippers, the patch is mounted to the lower surface 184. The patch is mounted to each side surface 186 of the tweezers. The patch can be mounted on one or more sides of the handle 188 of the toothbrush. The patch can be mounted on one or more sides 190 of the handle 192 of the electric hair dyer, and/or on its rear handle surface 194.

Figure 48:
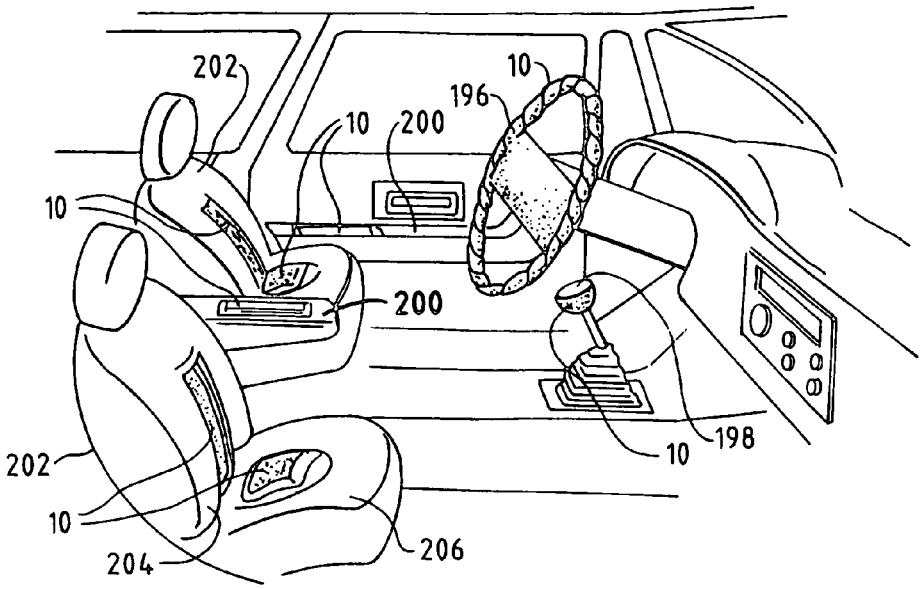
FIG. 48 is a perspective view of an automotive interior with deformable patches, according to another embodiment of the present invention.

As shown in FIG. 48, patches 10 of suitable sizes can be attached to various parts of an automobile interior, including wrapped around a steering wheel 196, on a shifter 198, on an armrest 200. The patch also can be attached to a seat 202, and in particular on the seat back 204 and/or on the seat bottom 206. The patch can also be applied decoratively to other portions of the interior.

Figure 49:
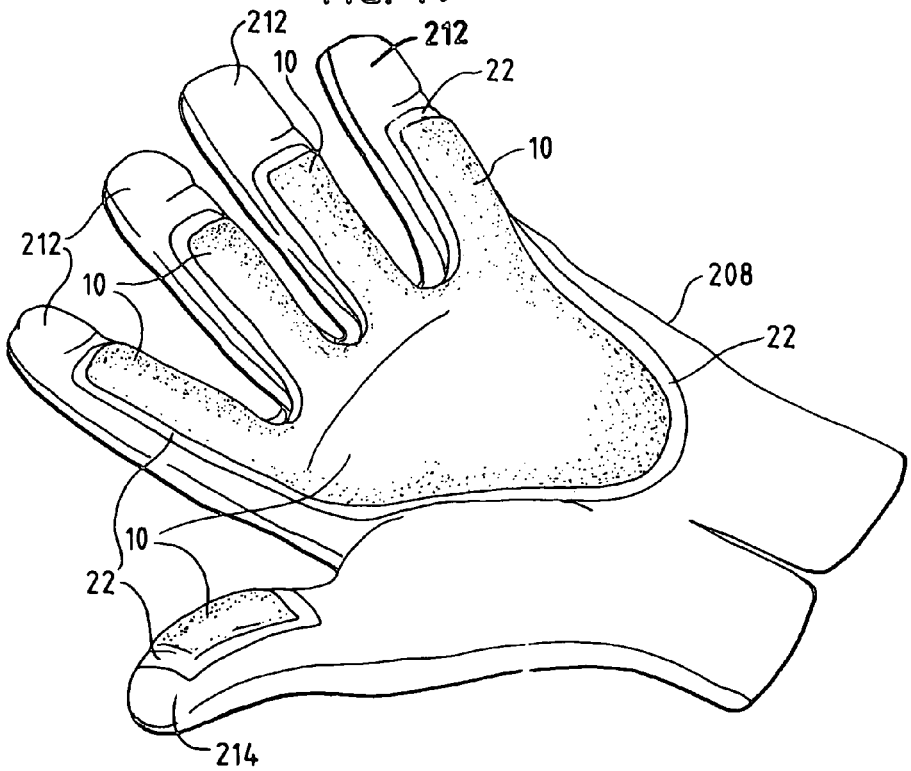
FIG. 49 is a perspective view of a glove with deformable patches, according to another embodiment of the present invention.

As shown in FIG. 49, one or more of the patches 10 can be attached to a glove 208. The glove has a palm portion 210 that includes a patch 10. The glove also has finger portions 212 that each include a patch 10. Finally, the glove has a thumb portion 214 that also includes a patch 10 mounted thereon.

Figure 50:
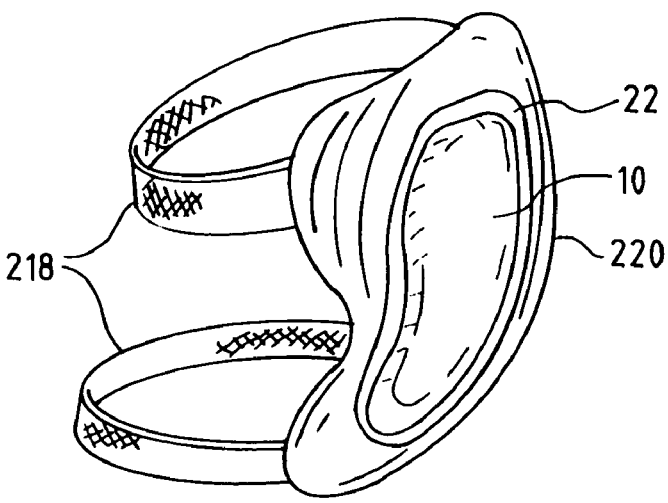
FIG. 50 is a perspective view of a protective guard with a deformable portion, according to another embodiment of the present invention.
Figure 51:
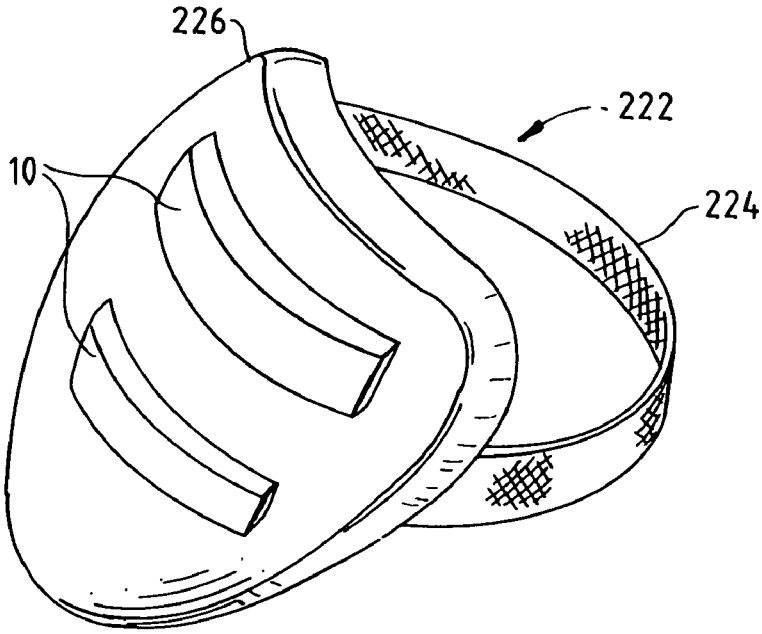
FIG. 51 is a perspective view of another protective guard with a deformable portion, according to another embodiment of the present invention.
Figure 52:
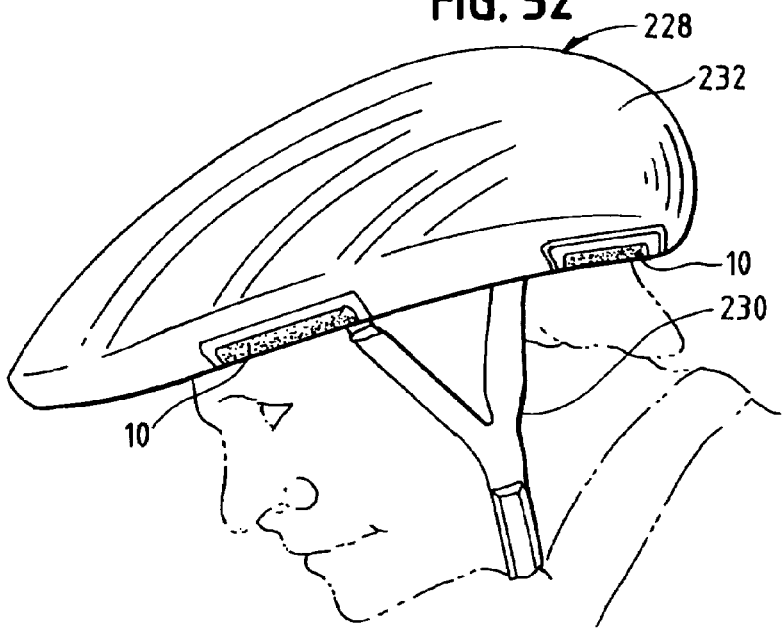
FIG. 52 is a perspective view of a helmet with a deformable portion, according to another embodiment of the present invention.
Figure 53:
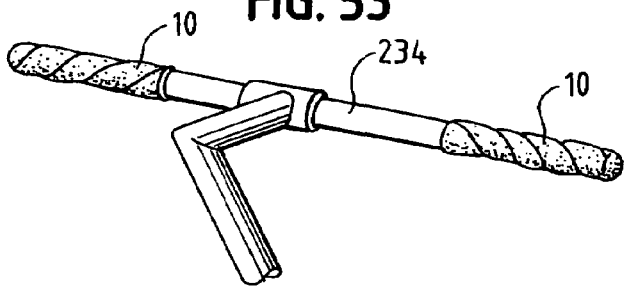
FIG. 53 is a perspective view of bicycle handlebars with deformable patches, according to another embodiment of the present invention.
Figure 54:
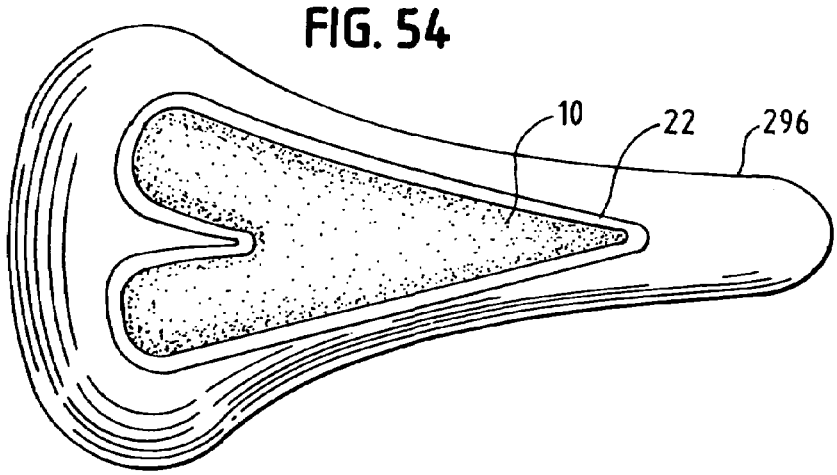
FIG. 54 is a perspective view of a bicycle seat with a deformable portion, according to another embodiment of the present invention.

The patch 10 also can be used on safety equipment, as is shown in FIGS. 50-52. FIG. 50 shows an elbow guard 216 that has two straps 218 and a guard plate 220. The straps can be adjustable or elastic so as to fit over the arms of a user. The patch 10 is attached to the guard plate to cushion impacts. FIG. 51 shows a knee guard 222 that has a strap 224 and a guard plate 226. The patch 10 is mounted on the guard plate. The patch also can be used on shin guards. FIG. 52 shows a helmet 228 that has a strap 230 and a helmet body 232 and/or the strap. One or more patches 10 can be mounted to the helmet body. Examples of helmets that can be fitted with the patch are bicycle, motorcycle, football, baseball and hockey helmets. As shown in FIGS. 53 and 54, the patch 10 also can be attached to bicycle components. In particular, the patch can be mounted to bicycle handlebars 234 and/or a bicycle seat 236.

Figure 55:
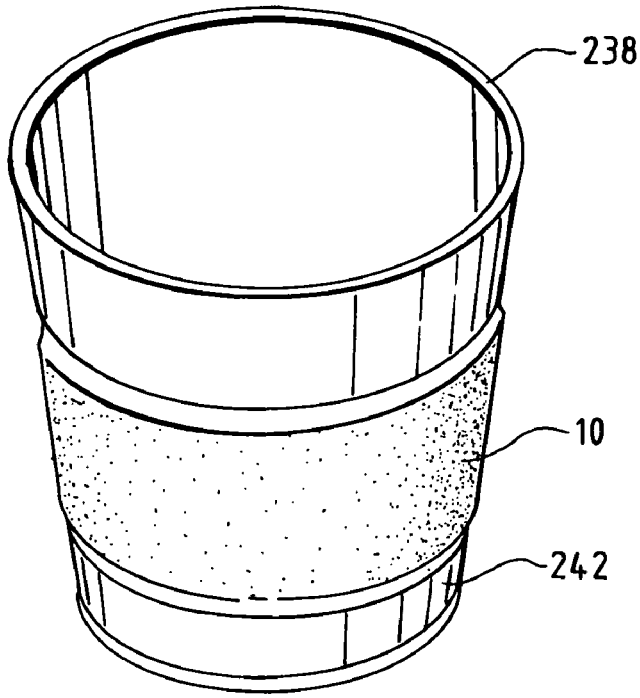
FIG. 55 is a perspective view of a cup with a deformable patch, according to another embodiment of the present invention.
Figure 56:
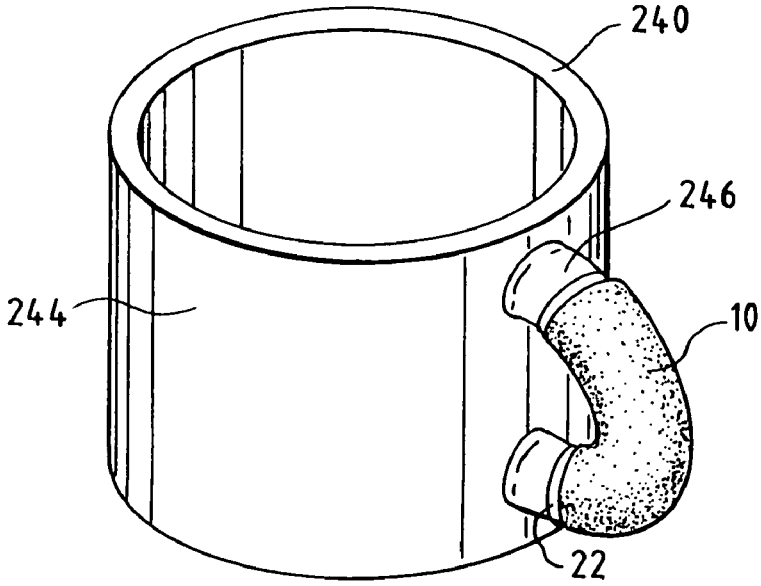
FIG. 56 is a perspective view of a mug with a deformable patch, according to another embodiment of the present invention.

As shown in FIGS. 55 and 56, the patch can be attached to a cup 238 and/or mug 240. The cup 238 has a curved body with an exterior surface 242 to which one or more patches 10 can be attached. The patch may extend all the way around the exterior surface of the cup. Likewise, the mug 240 has a curved exterior surface 244 with a handle 246. Patch 10 is mounted to the handle 246. Aluminum oxide can be added to the patch materials to provide for increased survivability in high temperature environments, such as dishwashers.

Figure 57:
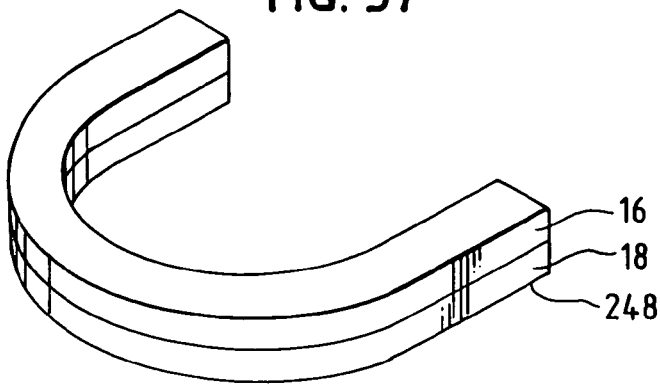
FIG. 57 is a perspective view of a deformable mouthguard according to another embodiment of the present invention.

FIG. 57 shows a deformable athletic mouthguard 248. The mouthguard is filled with formable material 20 and has a cross-section similar to that shown in FIG. 3A. The upper membrane 16 and the base 18 are made of flexible silicone material having a thickness sufficient to resist rupturing from dental pressure.

Figure 58:
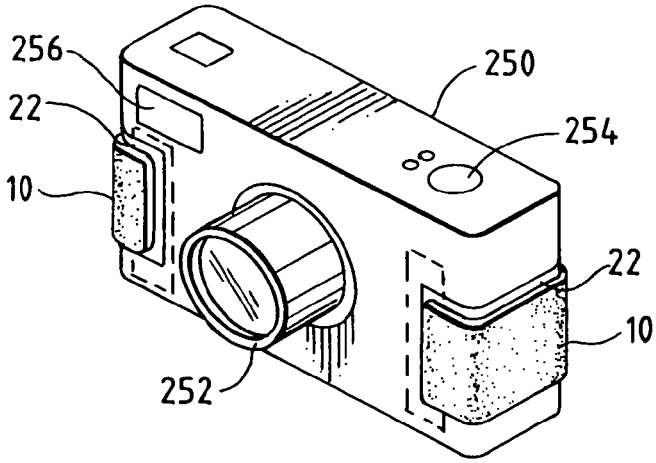
FIG. 58 is a perspective view of a camera with a deformable patch, according to another embodiment of the present invention.

FIG. 58 shows a camera 250 that includes two deformable patches 10. The camera has an optical lens assembly 252 to capture images. An activation button 254 is located on the top of the camera and a flash until 256 is located adjacent to the lens assembly. The patches 10 can alternatively be configured to have, increased width near the lens assembly, so as to provide increased room for the user's fingers. The dotted lines in FIG. 58 represent his optional patch size. It should be appreciated that the patch 10 could be mounted on cameras of any type, including digital and tape video cameras, still cameras and other optical recording devices.

Figure 59:
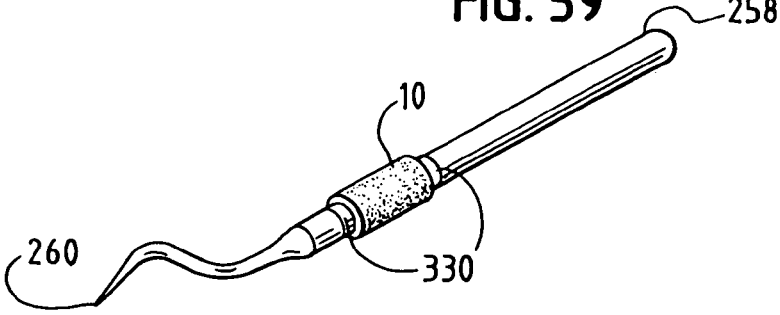
FIG. 59 is a perspective view of a dental pick with a deformable patch, according to another embodiment of the present invention.

A dental tool 258 incorporating the deformable patch 10 is shown in FIG. 59. The dental tool has a hard pointed end 260 for treating teeth. Aluminum oxide can be added to the patch material to increase the patch's resistance to high sterilization temperatures. Various shaped deformable patches can be attached to various dental tools, including drills, polishers, x-ray equipment, work station patches, and the like.

Figure 60:
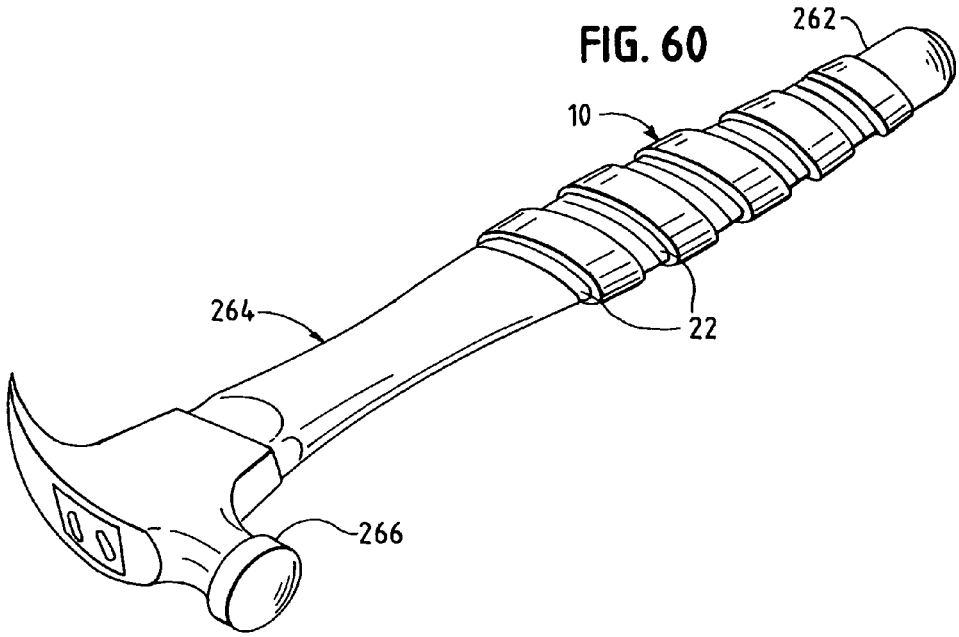
FIG. 60 is a perspective view of a hammer with a deformable patch, according to another embodiment of the present invention.

FIG. 60 shows the patch 10 attached to the handle 262 of a hammer 264. In this example, the patch 10 is sized to wrap around the handle of the hammer. The hammer has a metal head 266 configured to drive nails or the like. It should be appreciated that the patch can be configured to attach to any type of hand-held hammer device, such as a sledge hammer, ball-peen hammers, or mallets. The patch can likewise be applied to other tools that have handles.

Figure 61:
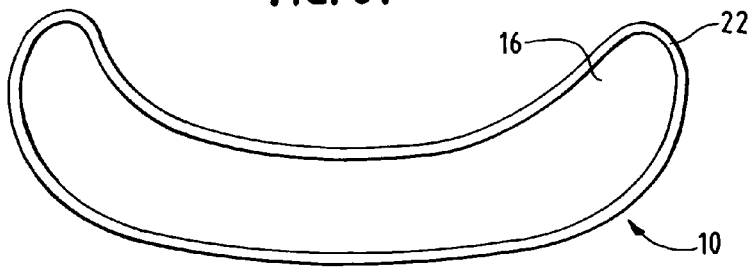
FIG. 61 is a plan view of a deformable patch, according to another embodiment of the present invention.

FIG. 61 shows an embodiment of the patch 10 that has a arc-like, or accurate, curved shape. Such a curved shape is well suited to receiving the user's fingertips, which tend to make contact with objects not in a straight line, but instead along a curved "footprint." The components of this patch 10 are the same as those described above and shown in FIG. 2. The patch has an optional edge portion 22 that can be configured as shown in FIG. 3 or 4. Alternatively, the edge portion can be configured as shown in FIG. 3A or 4A. A patch of this shape can be placed on a variety of products having differently shaped surfaces while still maintaining a generally curved area that is sized to accommodate the natural placement of the user's fingertips.

Figure 62:
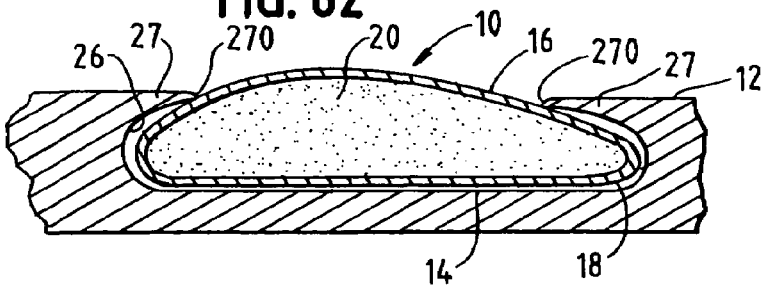
FIG. 62 is a cross-sectional view of a deformable patch of FIG. 3A, shown attached to a product.

Next, several alternative ways of attaching the patch 10 to the product 12 will be discussed. FIG. 62 shows an embodiment of the patch 10 and product 12 wherein the patch fits within a cavity 268 with an opening 270. The opening of the cavity is defined by overhanging edges 272. Adhesive may be used to hold the patch in the cavity, as may be required by a particular application. In addition, the overhanging edges need not be integral parts of the product 12. Instead the overhanging edges may be separate parts attached to the product 12.

Figure 63:
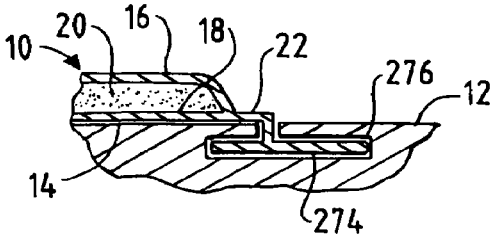
FIG. 63 is a detailed cross-sectional view of the deformable patch according to another embodiment of the present invention.

FIG. 63 shows an alternative configuration for the edge portion 22 of the patch 10. In particular, the edge portion may be configured to have a "T" shaped end 274. The "T" shaped end fits in a corresponding "T" shaped channel 276 in the surface of the product 12. Although the "T" shaped end and channel may adequately fasten the patch to the product, adhesive or mechanical fasteners may also be used.

Figure 64:
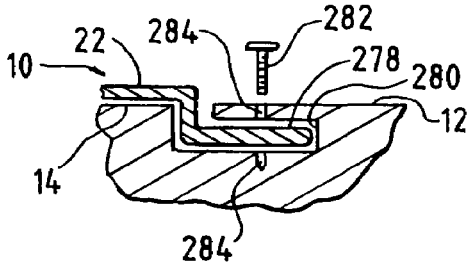
FIG. 64 is a detailed cross-sectional view of the deformable patch according to another embodiment of the present invention.

FIG. 64 shows yet another alternative configuration for the edge portion 22 of the patch 10. In particular, the edge portion may be configured to have an "L" shaped end 278 that fits in a corresponding "L" shaped channel 280 in the surface of the product 12. Although the "L" shaped end and channel may adequately fasten the patch to the product, adhesive or mechanical fasteners may also be used, such as screw 282, which fits into hole 284.

Figure 65:
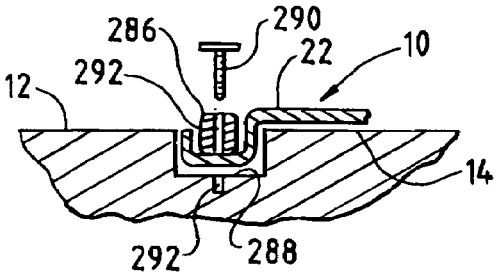
FIG. 65 is a detailed cross-sectional view of the deformable patch according to another embodiment of the present invention.

FIG. 65 shows yet another alternative method for attaching the edge portion 22 of the patch 10 to the product 12. In particular, the edge portion may be held between a rectangular member 286 and a corresponding channel 288 in the surface of the product 12. Adhesive or mechanical fasteners may also be used to compress the edge portion between the member and the channel, such as screw 290, which fits into hole 292.

Figure 66:
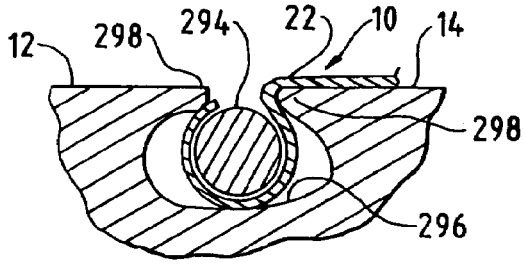
FIG. 66 is a detailed cross-sectional view of the deformable patch according to another embodiment of the present invention.

FIG. 66 shows yet another alternative method for attaching the edge portion 22 of the patch 10 to the product 12. In particular, the edge portion may be held between a rod 294 and a corresponding channel 296 in the surface of the product 12. The channel has overhanging edges 298. Adhesive or mechanical fasteners may also be used to compress the edge portion between the member and the channel, but the rod also may be sized to snap between the overhanging edges 298 of the channel 296.

Figure 67:
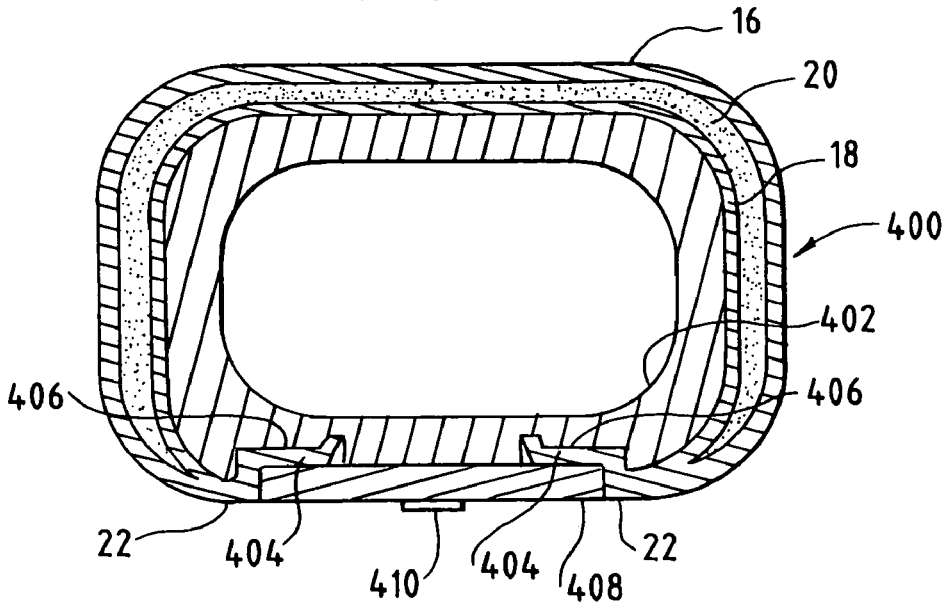
FIG. 67 is a cross section of an alternative embodiment of the deformable steering wheel grip of FIG. 48.
Figure 68:
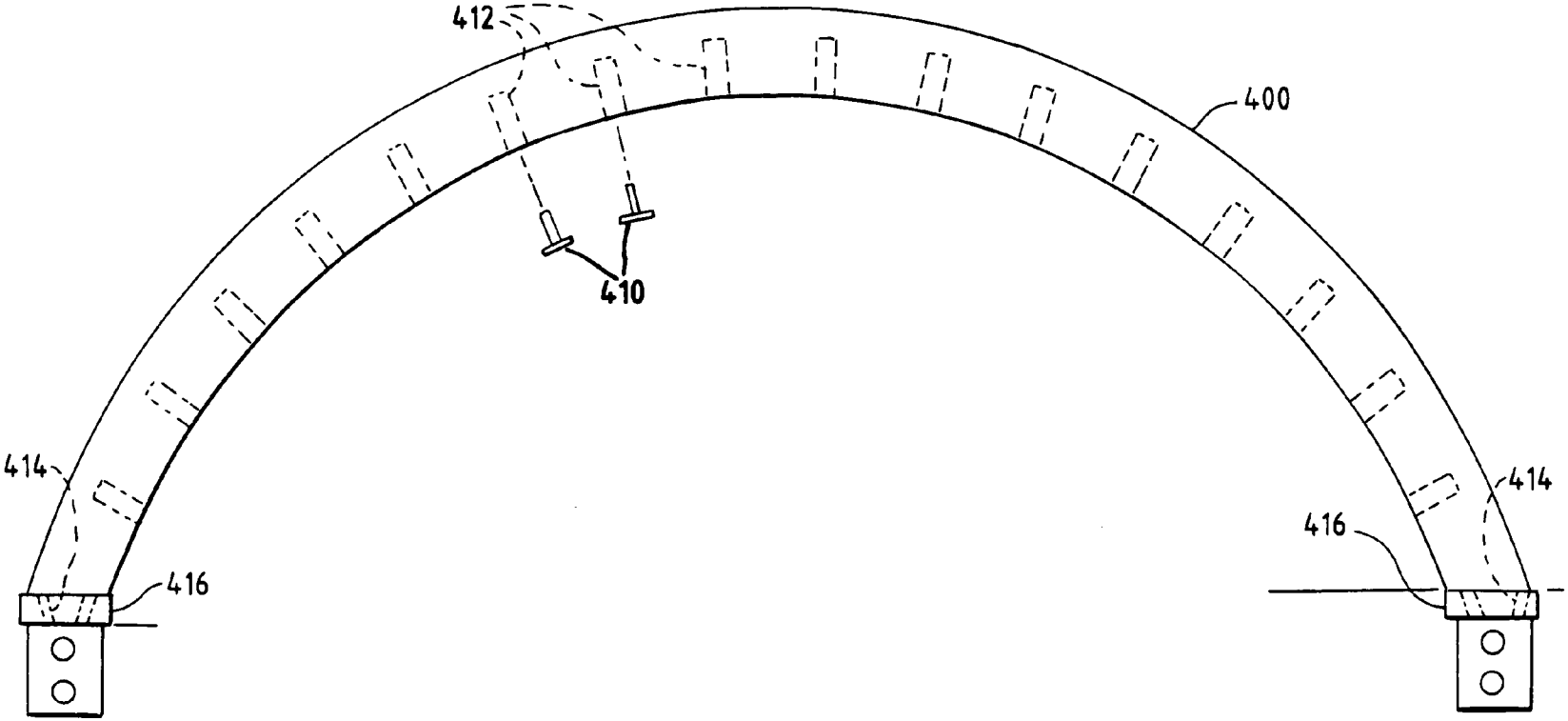
FIG. 68 is an elevational view of the deformable steering wheel grip of FIG. 67.

FIGS. 67 and 68 show an alternative steering wheel grip 400 that can be substituted for the steering wheel grip of FIG. 48. In particular, the grip has a flexible upper membrane 16 and a flexible membrane base 18, with the formable material 20 located therebetween. The grip 400 is mounted on the upper portion of the steering wheel 402. Although the steering wheel is shown as hollow in cross section, the grip may be mounted on a solid steering wheel or other steering wheel designs. Each edge portion of the grip has an indented "L" shaped end 404 that conforms to a mating surface 406 on the steering wheel. A mounting strip 408 fastened by screws 410 holds the "L" shaped ends of the side portion against the mating surface 406 of the steering wheel. A series of holes 412 sized to accept the screws is located along the underside of the upper portion of the steering wheel. The holes preferably are spaced about 1 inch apart. The mounting strip can be flexible or rigid. The grip 400 has two ends 414, each of which is held to the steering wheel by a circular ring 416. The grip 400 can be formed by an extrusion process and the ends 414 of the grip 400 can be formed by bonding the upper membrane to the base so as to enclose the formable material. The ends 414 of the grip look similar to the ends 330 of the sleeve shown in FIG. 5. The thickness of the formable material 20 preferably is 0.1 to 0.150 inch and the thickness of the upper membrane 16 preferably is 0.05 inch. The above described materials may be used for the grip 400.

A tubular patch embodiment 300 is shown in FIGS. 5-9. This sleeve 300 is suitable for attachment to products, such as a pen 302 or a pencil 304 with handles that are cylindrical or that otherwise have a curved or oval cross-section. The sleeve 300 preferably is deformable so that it will closely conform to the fingers of different users. If the sleeve is configured to resume its original shape, the sleeve can be deformed and hold its deformed shape for at least 5 seconds before slowly returning to its original shape. However, depending on the materials used, the sleeve may take much longer to return to its original shape or it may stay in its deformed shape. By conforming to the fingers of each user, the sleeve evenly distributes pressure to the user's fingers, thereby reducing stress and fatigue and increasing the comfort of the user. The sleeve can be permanent or temporary and can be easily removed and replaced in applications where such removal and replacement is advantageous.

Figure 6:
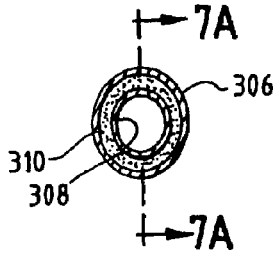
FIG. 6 is a cross-sectional view of the deformable sleeve of FIG. 5, taken in the direction of lines 6-6.
Figure 7A:
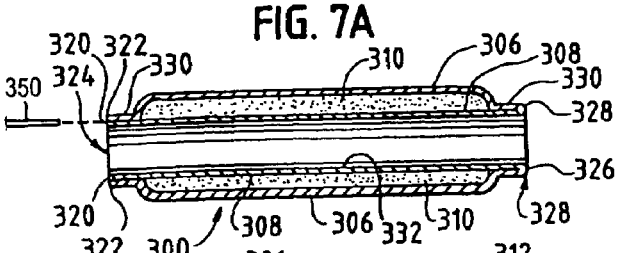
FIG. 7A is a cross-sectional view of the deformable sleeve of FIG. 6, taken in the direction of lines 7A-7A.
Figure 8:
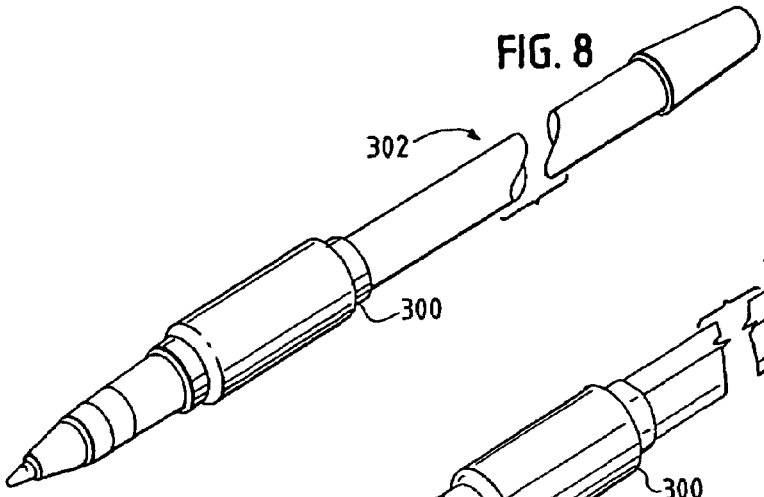
FIG. 8 is a perspective view of the deformable sleeve of FIG. 5, shown on a ball point writing instrument.
Figure 9:
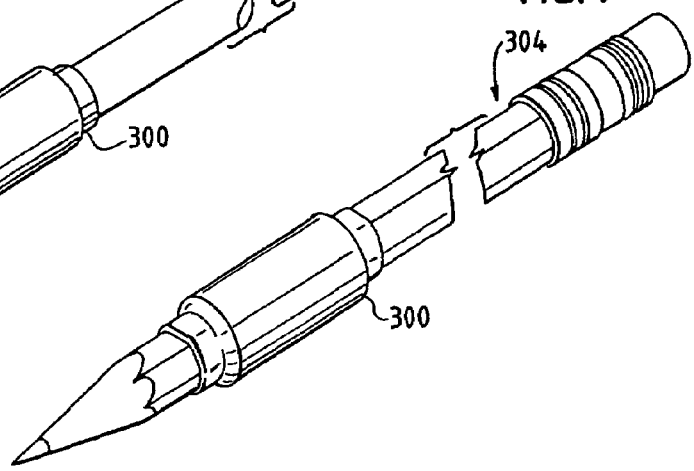
FIG. 9 is a perspective view of the deformable sleeve of FIG. 5, shown on a pencil writing instrument.

As shown in FIGS. 6 and 7A, the deformable sleeve 300 is closed cell having an outer membrane 306 and an inner base 308 that cooperatively encapsulate a formable material 310, like that described above. The base and membrane can be formed of any suitable material, including those described above. As shown in FIGS. 8 and 9, the sleeve can be attached to writing instruments, such as a pen 302 or a pencil 304. The sleeve 300 can be attached to other manual implements that have handles suitable for receiving the tubular-shaped patch 300.

Figure 7B:
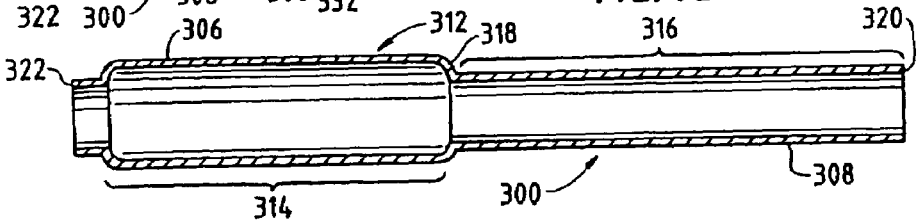
FIG. 7B is a cross-sectional view of the deformable sleeve of FIG. 7A, taken in the direction of lines 7A-7A.

FIGS. 7A and 7B illustrate the assembly of the sleeve 300. The sleeve can be formed by folding a long tubular member 312. The member 312 can be made of molded silicone material and has a larger diameter portion 314 and a smaller diameter portion 316 separated by a transition area 318, as shown in FIG. 7B. In order to form the sleeve 300 of FIG. 7A, the smaller diameter portion 316 is pulled inside the larger diameter portion 314 until the end 320 of the smaller diameter portion is aligned with the end 322 of the larger diameter portion. This can be accomplished by placing the end of a cylindrical tool (not shown) inside the end 320 of the smaller diameter portion 316 and then by moving the larger diameter portion 314 toward the tool and the end of the smaller diameter portion. The tool may be tapered so as to fold the end of the smaller diameter portion radially inwardly, into a position where the end forms a 180° fold and points toward the end of the larger portion. The larger diameter portion is then moved relatively to the smaller portion so the folded end of the smaller portion moves inside the larger portion until the end of the smaller portion is aligned with the end of the larger portion, there by forming one end 324 of the sleeve 300 of FIG. 7A. The other end 326 of the sleeve 300 has a 180° fold 328 and thus does not need any bonding or fastening in order to hold the formable material 310. If the smaller diameter portion 316 is made of rigid material, the larger diameter portion could be folded 180° radially outwardly and pulled over the smaller diameter portion.

When the ends 320 and 322 of the smaller and larger diameter portions 316 and 314 are aligned, the larger diameter portion 314 forms the outer membrane 306 and the smaller diameter portion 316 forms the base 308. The cavity for the formable material 310 is located in the radial space between the base and the outer membrane, which are positioned in a concentric relationship. A small tube 350 can be used to inject the formable material 310 between the ends 320 and 322 of the portions and into the cavity. In order to allow air bubbles to escape, the folded end 328 of the sleeve 300 can be placed below the other end 324 of the sleeve. When the formable material 310 has filled the cavity, the tube 350 is removed and the ends of the larger and smaller portion can then be sealed by heat or adhesive, as described above. In addition, before the open end 324 of the sleeve 300 is sealed, a mold may be used to squeeze the outer membrane 306 so as to drive any trapped air out of the sleeve prior to sealing. Alternatively, the sleeve 300 can be formed by placing uncatalyzed material in a press, filling the uncatalyzed material with formable material, and then heating the uncatalyzed material in a heat press to form inner and outer membranes 306 and 308.

The length of the smaller diameter portion 316 can be slightly longer than that of the larger diameter portion 314 so as to create flat edge portions 330 at either end of the sleeve 300. When assembled, the sleeve 300 has a radially inner surface 332 that preferably is cylindrical so as to fit over a product such as a writing instrument body. The sleeve can be held in place by simple friction fit, by adhesives or by mechanical fasteners that hold the flat edge portions 330 at the ends of the sleeve 300. It should be appreciated that, depending on the application, the sleeve may be configured so that the edge portions 330 are minimized or even eliminated. The sleeve need not have such flat edge portions, depending on the requirements of a particular application. Mechanical fasteners may be used to hold the sleeve 300 even if it is configured without flat edge portions 330. The sleeve's edge portions 330 also could be configured as multiple tabs projecting away from each end of the sleeve. The sleeve can be formed by extruding, molding, or other suitable manufacturing processes.

Because the patches identified above can be made with colored materials, the patches can be used to provide an aesthetically pleasing product appearance without much additional increase to the manufacturing cost of the product. In addition, in particular applications such as in the chair of FIG. 25, the patches can provide a comfortable surface for a user to rest his or her arms.

While a particular form of the invention has been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

The invention claimed is:

1. A writing instrument comprising:

an elongate body having first and second ends;

a writing mechanism projecting from the body first end; and a deformable sleeve having a generally tubular base with a first diameter and defining an inner surface engaging the body near the writing mechanism, a generally tubular outer membrane with a second diameter larger than the first diameter positioned generally concentric with the base, the base and outer membrane defining a cavity therebetween, respective ends of the base and outer membrane engaging to form an annular sealable passageway therebetween, the annular sealable passageway being in fluid communication with the cavity, the respective ends of the base and outer membrane being oriented in the same direction and facing away from the second end of the elongate body thereby forming one end of the deformable sleeve, and a formable material disposed through the annular sealable passageway and into the cavity.

2. The writing instrument of claim 1, in which the base and outer membrane are integrally formed from a single piece of material.

3. The writing instrument of claim 2, in which the single piece of material comprises an elongate, flexible tubular member having a first end, a second end, a larger diameter portion, and a smaller diameter portion, wherein the smaller diameter portion is partially disposed within the larger diameter portion such that the smaller diameter portion is folded and the first and second ends are adjacent to and contact each other, thereby forming the base and outer membrane.

4. The writing instrument of claim 3, in which the smaller diameter portion defines a 180 degree fold.

5. The writing instrument of claim 1, in which the base and outer membrane are generally cylindrical.

6. The writing instrument of claim 1, in which the base and outer membrane are bonded together.

7. The writing instrument of claim 1, in which the formable material holds a deformed shape for at least 5 seconds following release by a user of the outer membrane.

8. The writing instrument of claim 1, in which opposite ends of the base and outer membrane engage one another to form flat edge portions on opposite ends of the sleeve.

9. The writing instrument of claim 1, in which the base inner surface is sized to frictionally engage the body.

10. A writing instrument comprising:

an elongate body having first and second ends;

a writing mechanism projecting from the body first end; and a deformable sleeve having a generally tubular base with a first diameter and defining an inner surface engaging the body near the writing mechanism, a generally tubular outer membrane with a second diameter larger than the first diameter positioned generally concentric with the base, wherein respective ends of the base and outer membrane engage to define a cavity therebetween, a sealable passageway defined between adjacent ends of the tubular base and outer membrane in fluid communication with the cavity, and a formable material disposed in the cavity, wherein the formable material holds a deformed shape for at least 5 seconds following release by a user of the outer membrane.

* * * * *